US005853430A

United States Patent [19]

Shindo et al.

[11] Patent Number: 5,853,430

[45] Date of Patent: Dec. 29, 1998

[54] METHOD FOR PREDISSOLVING DETERGENT COMPOSITIONS

[75] Inventors: Kenji Shindo, Kobe; Ayako Muramatsu, Nishinomiya; Susumu Murata, Kobe, all of Japan; Nabil Yaqub Sakkab; Harry Leroy Coleman, Jr., both of Cincinnati, Ohio

[73] Assignee: The Procter & Gamble Company, Cincinnati, Ohio

[21] Appl. No.: 922,776

[22] Filed: Sep. 3, 1997

[51] Int. Cl.[6] ..... D06L 1/16; D06L 1/12

[52] U.S. Cl. ..... 8/137; 8/142; 510/293; 510/295; 510/302; 510/303; 510/367; 510/369; 510/220; 510/221

[58] Field of Search ..... 8/137, 142; 510/293, 510/295, 302, 303, 367, 369, 220, 221

[56] References Cited

U.S. PATENT DOCUMENTS 4,555,019 11/1985 Spendel .
4,879,051 11/1989 Lo et al. ..... 510/327

FOREIGN PATENT DOCUMENTS 52-67547 5/1977 Japan .
62-28755 2/1987 Japan .

*Primary Examiner*—Alan Diamond
*Attorney, Agent, or Firm*—Steven R. Chuey; Kim W. Zerby; Jacobus C. Rasser

[57] ABSTRACT

The present invention is directed to a method for predissolving a detergent composition having the steps of providing a hand-held container; and combining a detergent composition and a solvent in the container to form a concentrated detergent solution. The concentrated detergent solution preferably has a surface tension value of from about 10 to about 50 dyne/cm.

19 Claims, 1 Drawing Sheet

METHOD FOR PREDISSOLVING DETERGENT COMPOSITIONS

The present invention relates to a method for predissolving a detergent composition in a container which can be hand-held.

BACKGROUND

Removing tough soils and stains from garments, such as collar dirt, sock dirt, clay and mud, and difficult food stains is a challenge for many consumers. Usually, the consumer does not rely on the washing machine alone to substantially remove such tough stains. Consumers commonly pre-treat the fabric to obtain an acceptable degree of cleanness for tough stains before placing the garments in the washing machine. For example, before placing the garments in the washing machine, consumers pre-treat on certain areas of the garment, such as particularly soiled areas, e.g. individual spots, or areas habitually more heavily soiled, e.g. shirt collars and cuffs. Consumers may hand scrub a certain area of the garment using a toilet or laundry soap bar, or directly apply to certain fabric areas other commercially available pre-treatment products. Such pre-treatment products exist in various physical forms such as a liquid, gel or paste detergent composition. Consumers also commonly pre-soak garments which have hard to remove soils and stains on the fabric. For example, consumers pre-soak the fabrics in a detergent or bleach-containing detergent solution in a small wash basin or in the washing machine tub for a period of time, e.g. one hour to overnight. Then the consumer takes the pre-soaked garments and washes the garments in the normal machine wash process.

The extra time and effort consumers take to pre-treat and/or pre-soak is inconvenient and adds steps to the laundering process. Apart from the inconvenience to the user, pretreatment with an additional product increases the total cost of the wash.

Detergent compositions sometimes do not adequately dissolve during the washing cycle in the washing machine, leaving deposits of detergent on the fabric even after the washing process has been completed. This is especially true with granular detergent compositions and is a particular problem when the water temperature used in the machine is low, e.g. 20° C. and below. Detergent compositions also do not dissolve adequately in washing machines which have short wash cycles, e.g. about 10 minutes. Remaining deposits of detergent left on washed garments are highly undesirable to consumers, since consumers must re-wash the garments.

Detergent compositions which do not adequately dissolve during the washing cycle, or are used in adverse washing conditions such as a short wash cycle and low water temperature, also do not deliver satisfactory cleaning performance. For example, bleaching performance is hindered in such adverse washing conditions.

Although not intended to be limited by theory, bleach containing detergent compositions with bleach activators liberate peracid to bleach the fabric. However, under actual wash conditions, bleach performance is limited because adverse wash conditions limit the generation of peracid. Such bleach-containing compositions perform inefficiently in wash solutions when they come in contact with the wash solution prior to complete peracid generation. Based on the foregoing there is a need for an improved means for introducing detergent composition to the washing and/or cleaning process.

SUMMARY

The present invention is directed to a method for predissolving a detergent composition having the steps of providing a hand-held container; and combining a detergent composition and a solvent in the container to form a concentrated detergent solution.

These and other features, aspects, and advantages of the present invention will become evident to those skilled in the art from a reading of the present disclosure.

BRIEF DESCRIPTION OF THE DRAWING

The specification will be more fully understood when viewed in connection with the drawing which sets forth an embodiment of a hand held container according to the present invention.

DETAILED DESCRIPTION

Figure 1:
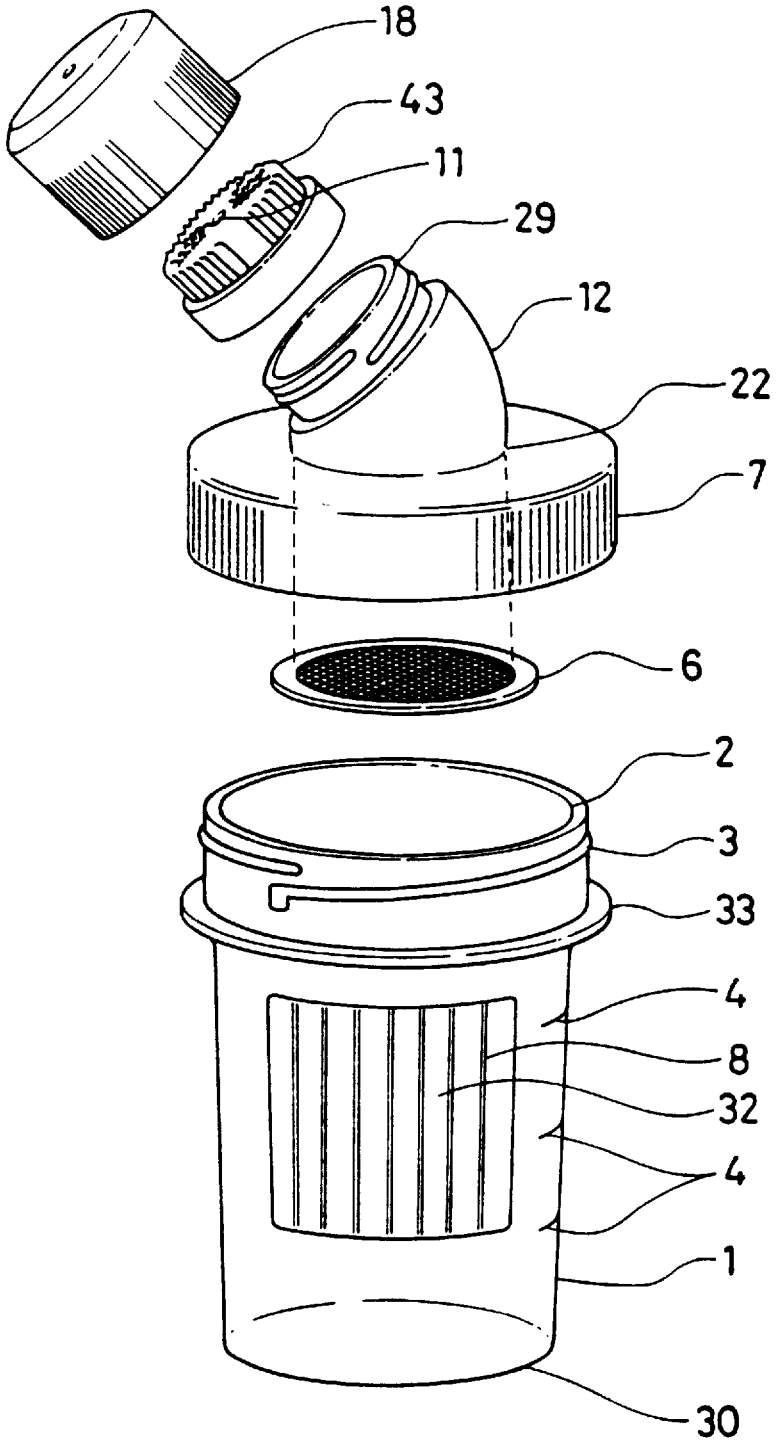

While this specification concludes with claims distinctly pointing out and particularly claiming that which is regarded as the invention, it is believed that the invention can be better understood through a careful reading of the following detailed description of the invention.

All percentages and proportions are by weight, all temperatures are expressed in degrees Celsius (° C.), molecular weights are in weight average, unless otherwise indicated.

Examples of the invention are set forth hereinafter by way of illustration and are not intended to be in any way limiting of the invention.

All ratios are weight ratios unless specifically stated otherwise.

As used herein, "comprising" means that other steps and other ingredients which do not affect the end result can be added. This term encompasses the terms "consisting of" and "consisting essentially of".

All cited references are incorporated herein by reference in their entireties. Citation of any reference is not an admission regarding any determination as to its availability as prior art to the claimed invention.

As used herein, the term "alkyl" means a hydrocarbyl moiety which is straight or branched, saturated or unsaturated. Unless otherwise specified, alkyls are preferably saturated or unsaturated with double bonds, preferably with one or two double bonds.

As used herein, the term "detergent composition" or "detergent" is intended to designate any of the agents conventionally used for removing soil, such as general household detergents or laundry detergents of the synthetic or soap type. The term is intended to also include other cleaning compositions, such as dishwashing liquid, hard surface cleaners, and so forth.

The present invention relates to a method for predissolving a detergent composition having the following steps: (1) providing a hand-held container; and (2) combining a detergent composition and a solvent in the container to form a concentrated detergent solution.

A predetermined amount of the detergent composition and the solvent are combined in the container. Preferably, the mixture is agitated in order to help facilitate the mixing and dissolving of the mixture of the detergent composition and solvent. The resultant solution is a concentrated detergent solution which can be introduced to the fabric in various ways, such as for pre-treating the fabric, pre-soaking the fabric, and/or for use in hand washing or in a washing machine. Although the specification mentions the method of use to be applicable in a laundry process, the method of use also encompasses other uses. The container and concentrated detergent solution described herein are applicable to many types of cleaning operations, such as cleaning and/or pre-treating surfaces such as hard surfaces, dishes, walls, carpets, wallpaper, and other items. Although the cleaning of "fabrics" is mentioned, the invention is also meant to include the cleaning of other surfaces besides "fabrics" such as mentioned above.

A concentrated detergent composition made by the method of the present invention has improved overall cleaning performance, especially on particularly soiled areas. In addition, it obviates the need to use a separate pre-treating or pre-soaking product in addition to the detergent composition for use in the washing machine; thereby resulting in saving time and additional cost. The method of the present invention also effectively predissolves the detergent composition, resulting in many benefits. For example, there are less deposits of undissolved detergent onto fabric, cleaning performance is increased, and for bleach-containing compositions, better bleaching performance is observed. Even for machine washing conditions which are adverse, such as short washing cycles and/or the use of low temperature water, overall cleaning performance is surprisingly improved using a concentrated detergent composition made by the method of the present invention.

Components of the invention are discussed in more detail below.

A. Hand-held container

In the first step of the present invention, a hand-held container is provided. The container is of a size which can be hand-held. The term "hand-held" with respect to the container is used herein to indicate that the size of the container is such that the container could be held in one or both hands. However, it does not mean that the container must be hand-held to practice the present invention.

The predissolving takes place within the container when the detergent composition and the solvent are combined to form a concentrated detergent solution. One embodiment of the hand-held container is a reusable container. Alternatively, the container can be of the single-use (i.e. disposable) variety. The container preferably has space within the container for "overflow" (see discussion below).

A preferred hand-held container for predissolving is described herein. The container has a housing, a resilient side wall, and a dispensing passage with an applicator at the distal end. The container is intended for use with fluids of greater than about 500 centipoise (cp) at 21° C. viscosity. When so used, and aligned to a dispensing orientation, fluid flows out of the dispensing passage at a rate of from about 0 ml/min to about 300 ml/min, unless manual pressure is exerted on the resilient side wall. When manual pressure is exerted upon the resilient side wall, the flow rate can increase beyond 300 ml/min. The term "dispensing orientation" is defined as a position such that the applicator is touching the surface to be cleaned, or the applicator is parallel to the plane of the item to be cleaned.

A preferred embodiment of a hand-held container is shown in FIG. 1. The housing, 1, contains a wide mouth, 2. The diameter of the mouth is 55 mm. The cross section of housing, 1, changes from a circle, at the mouth, 2, to an oval with flattened ends at the bottom of the housing, 30. Lip, 33, provides added structural rigidity and further serves to catch drips of solution. The housing, 1, also has multiple level indicators, 4, a resilient side wall, 32, and a frictional surface, 8.

FIG. 1 also illustrates a filter, 6, which removably attaches to the cap member, 7, via a plurality of filter ridges (not shown), and substantially covers the neck base, 22. The cap member, 7, also has a curved neck portion, 12, topped with a distal end, 29, to which is attached an aperture, 11, surrounded by a brush-type applicator, 43. Removably connected to the neck portion, 12, is a water-tight aperture cover, 18. The cap member, 7, and the housing, 1, form a water-tight seal via a fastener, 3, which is a 180 degree closure, which insures that when the container is assembled for use, the applicator, 10, and the aperture, 11, lie in the plane of symmetry formed by the container. The neck angle is about 135 degrees, and a filter has a mesh size of about 180 microns.

B. Concentrated Detergent Solution

In the second step of the present invention, a detergent composition and a solvent are combined in the container to form a concentrated detergent solution. Preferably, the concentrated detergent solution has a surface tension value of from about 10 to about 50 dyne/cm. Even a more preferred surface tension value of the concentrated detergent solution of the present invention is from about 20 to about 40 dyne/cm, and more preferably still from about 25 to about 35 dyne/cm.

Surface tension is defined as the attractive force exerted by the molecules below the surface upon those at the surface/air interface, resulting from the high molecular concentration of a liquid compared to the low molecular concentration of a gas. See Richard J. Lewis, Sr., *Hawley's Chemical Dictionary* (12th ed. 1993). See also Edgar Woollatt, *The Manufacture of Soaps, Other Detergents and Glycerine* (1st ed. 1985).

Surface tension is measured in the unit of "dyne/cm". 1 dyne/cm is equivalent to the SI unit of $10^{-3}$ N/m.

Specifically, if the detergent composition is a granular detergent composition or a tablet composition, the concentrated detergent solution preferably has the following relationship: (1) the weight ratio of the detergent composition to the weight ratio of the solvent is from about 10:1 to 1:1000, and (2) the volume ratio of the solvent to the volume of the container is from about 1:1 to 1:100. A more preferred range is a weight ratio of the detergent composition to solvent from about 10:1 to 1:100 and wherein the volume ratio of the solvent volume to the container volume is from about 1:1 to 1:10. An even more preferred range is a weight ratio of the detergent composition to solvent from about 5:1 to 1:10 and wherein the volume ratio of the solvent volume to the container volume is from about 1:1 to 1:5

The preferred relationship of volume ratio of the solvent to the volume of the container is important so that there is sufficient "overflow" volume in the container. By "overflow" volume, it is meant to describe the volume in the container which is not taken up by the volume of the concentrated detergent solution. If there is not enough "overflow" volume in the container, the agitating by shaking (see below) does not work as efficiently to accelerate the dissolving process of the detergent composition in the solvent.

Table 1 lists examples of concentrated detergent solutions of the present invention:

TABLE 1

| Examples | 1 | 2 | 3 | 4 | 6 | 7 | 8 |
|---|---|---|---|---|---|---|---|
| Detergent Comp. | 30 g granules | 60 g granules | 30 g granules | 60 g HDL | 30 g paste | 30 g paste or gel | 60 g tablet |
| Water | 180 g | 150 g | 100 g | 30 g | 180 g | 20 g | 200 g |
| Ethanol (99.5%)[1] | 0 | 0 | 80 g | 0 | 0 | 0 | 0 |
| Xylene sulfonic acid (95%)[2] | 0 | 0 | 0 | 0 | 0 | 5 g | 0 |
| PoIy(ethylene-glycol)(100%)[3] | 0 | 0 | 0 | 0 | 0 | 20 g | 0 |
| Temperature of Solvent[4] | 20° C. | 40° C. | 10° C. | 20° C. | 20° C. | 20° C. | 20° C. |
| Volume of container | 300 $cm^3$ | 300 $cm^3$ | 300 $cm^3$ | 180 $cm^3$ | 300 $cm^3$ | 150 $cm^3$ | 300 $cm^3$ |
| Weight ratio[5] | 1/6 | 1/2.5 | 1/6 | 2/1 | 1/6 | 1/1.5 | 1/3.3 |
| Volume ratio[6] | 1/1.67 | 1/2 | 1/1.5 | 1/6 | 1/1.67 | 1/3.6 | 1/1.5 |
| Surface Tension | 28 dyne/cm | 24 dyne/cm | 28 dyne/cm | 27 dyne/cm | 32 dyne/cm | 30 dyne/cm | 30 dyne/cm |

[1]Density = 0.80 g/mL
[2]Density = 1.27 g/mL
[3]Density = 1.13 g/mL. Molecular weight = 300.
[4]The temperature of the solvent is measured right before the solvent is added to the container.
[5]Weight ratio is the weight ratio of the detergent composition to the solvent.
[6]Volume ratio is the volume ratio of the solvent to the volume of the container.

C. Detergent Composition

What type of detergent composition to use in the current invention should be determined by the surface to be cleaned. For example, if the user desires to wash fabrics, laundry detergent compositions are most preferable. Preferably, for washing fabrics, the detergent composition comprises a bleach and/or a bleach activator. The preferred bleach is a preformed peracid bleach and/or a peroxygen bleach. The detergent composition also preferably contains a surfactant, but this is not a required component. If the user desires to wash hard surfaces such as tables, dishes, and floors, hard surface cleaners are most preferable.

Conventional detergent composition ingredients are described in detail below. The detergent composition can be in any physical form, such as a granule, paste, liquid, gel, tablet, or solid detergent composition.

The detergent compositions herein can optionally include one or more detergent materials or other materials for assisting or enhancing cleaning performance, treatment of the substrate to be cleaned, or to modify the aesthetics of the detergent composition (e.g., perfumes, colorants, dyes, etc.). The following are illustrative examples of such optional detergent materials. The list of components is non-limiting.

1. Detersive Surfactant

The detergent composition optionally comprises a detersive surfactant. Preferably the detergent composition comprises at least about 0.01% of a detersive surfactant; more preferably at least about 0.1%; more preferably at least about 1%; more preferably still, from about 1% to about 55%.

(1) Anionic Surfactants:

Nonlimiting examples of anionic surfactants useful herein, typically at levels from about 0.1% to about 50%, by weight, include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)$ $CH_3$ and $CH_3$ $(CH_2)_y(CHOSO_3^-M^+)$ $CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alpha-sulfonated fatty acid esters, the $C_{10}$–$C_{18}$ sulfated alkyl polyglycosides, the $C_{10}$–$C_{18}$ alkyl alkoxy sulfates ("$AE_xS$"; especially EO 1–7 ethoxy sulfates), and $C_{10}$–$C_{18}$ alkyl alkoxy carboxylates (especially the EO 1–5 ethoxycarboxylates). The $C_{12}$–$C_{18}$ betaines and sulfobetaines ("sultaines"), $C_{10}$–$C_{18}$ amine oxides, and the like, can also be included in the overall compositions. $C_{10}$–$C_{20}$ conventional soaps may also be used. If high sudsing is desired, the branched-chain $C_{10}$–$C_{16}$ soaps may be used. Other conventional useful anionic surfactants are listed in standard texts.

Other suitable anionic surfactants that can be used are alkyl ester sulfonate surfactants including linear esters of $C_8$–$C_{20}$ carboxylic acids (i.e., fatty acids) which are sulfonated with gaseous $SO_3$ according to "The Journal of the American Oil Chemists Society", 52 (1975), pp. 323–329. Suitable starting materials would include natural fatty substances as derived from tallow, palm oil, etc.

Other anionic surfactants useful for detersive purposes can also be included in the laundry detergent compositions. These can include salts (including, for example, sodium, potassium, ammonium, and substituted ammonium salts such as mono-, di- and triethanolamine salts) of soap, $C_8$–$C_{22}$ primary of secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl glycerol sulfonates, fatty acyl glycerol sulfonates, fatty oleoyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinates (especially saturated and unsaturated $C_{12}$–$C_{18}$ monoesters) and diesters of sulfosuccinates (especially saturated and unsaturated $C_6$–$C_{12}$ diesters), sulfates of alkylpolysaccharides such as the sulfates of alkylpolyglucoside (the nonionic nonsulfated compounds being described below), and alkyl polyethoxy carboxylates such as those of the formula $RO(CH_2CH_2O)_k$—$CH_2COO$—M+ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are described in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

A preferred disulfate surfactant has the formula

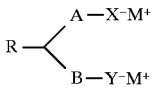

where R is an alkyl, substituted alkyl, alkenyl, aryl, alkaryl, ether, ester, amine or amide group of chain length $C_1$ to $C_{28}$, preferably $C_3$ to $C_{24}$, most preferably $C_8$ to $C_{20}$, or hydrogen; A and B are independently selected from alkyl, substituted alkyl, and alkenyl groups of chain length $C_1$ to $C_{28}$, preferably $C_1$ to $C_5$, most preferably $C_1$ or $C_2$, or a covalent bond, and A and B in total contain at least 2 atoms; A, B, and R in total contain from 4 to about 31 carbon atoms; X and Y are anionic groups selected from the group consisting of sulfate and sulfonate, provided that at least one of X or Y is a sulfate group; and M is a cationic moiety, preferably a substituted or unsubstituted ammonium ion, or an alkali or alkaline earth metal ion.

The disulfate surfactant is typically present at levels of incorporation of from about 0.1% to about 50%, preferably from about 0.1% to about 35%, most preferably from about 0.5% to about 15% by weight of the detergent composition.

When included therein, the laundry detergent compositions typically comprise from about 0.1% to about 50%, preferably from about 1% to about 40% by weight of an anionic surfactant.

(2) Nonionic Surfactants:

Nonlimiting examples of nonionic surfactants useful herein typically at levels from about 0.1% to about 50%, by weight include the alkoxylated alcohols (AE's) and alkyl phenols, polyhydroxy fatty acid amides (PFAA's), alkyl polyglycosides (APG's), $C_{10}$–$C_{18}$ glycerol ethers, and the like.

More specifically, the condensation products of primary and secondary aliphatic alcohols with from about 1 to about 25 moles of ethylene oxide (AE) are suitable for use as the nonionic surfactant in the detergent composition. The alkyl chain of the aliphatic alcohol can either be straight or branched, primary or secondary, and generally contains from about 8 to about 22 carbon atoms.

Examples of commercially available nonionic surfactants of this type include: Tergitol™ 15-S-9 (the condensation product of $C_{11}$–$C_{15}$ linear alcohol with 9 moles ethylene oxide) and Tergitol™ 24-L-6 NMW (the condensation product of $C_{12}$–$C_{14}$ primary alcohol with 6 moles ethylene oxide with a narrow molecular weight distribution), both marketed by Union Carbide Corporation; Neodol™ 45-9 (the condensation product of $C_{14}$–$C_{15}$ linear alcohol with 9 moles of ethylene oxide), Neodol™ 23-3 (the condensation product of $C_{12}$–$C_{13}$ linear alcohol with 3 moles of ethylene oxide), Neodol™ 45-7 (the condensation product of $C_{14}$–$C_{15}$ linear alcohol with 7 moles of ethylene oxide) and Neodol™ 45-5 (the condensation product of $C_{14}$–$C_{15}$ linear alcohol with 5 moles of ethylene oxide) marketed by Shell Chemical Company; Kyro™ EOB (the condensation product of $C_{13}$–$C_{15}$ alcohol with 9 moles ethylene oxide), marketed by The Procter & Gamble Company; and Genapol LA O3O or O5O (the condensation product of $C_{12}$–$C_{14}$ alcohol with 3 or 5 moles of ethylene oxide) marketed by Hoechst.

Another class of preferred nonionic surfactants for use herein are the polyhydroxy fatty acid amide surfactants of the formula.

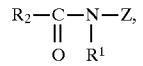

wherein $R^1$ is H, or $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Typical examples include the $C_{12}$–$C_{18}$ and $C_{12}$–$C_{14}$ N-methylglucamides. See U.S. Pat. Nos. 5,194,639 and 5,298,636. N-alkoxy polyhydroxy fatty acid amides can also be used; see U.S. Pat. No. 5,489,393.

Also useful as a nonionic surfactant in the detergent composition are the alkylpolysaccharides such as those disclosed in U.S. Pat. No. 4,565,647, Llenado, issued Jan. 21, 1986, having a hydrophobic group containing from about 6 to about 30 carbon atoms, preferably from about 10 to about 16 carbon atoms, and a polysaccharide, e.g. a polyglycoside, hydrophilic group containing from about 1.3 to about 10, preferably from about 1.3 to about 3, most preferably from about 1.3 to about 2.7 saccharide units.

Polyethylene, polypropylene, and polybutylene oxide condensates of alkyl phenols are also suitable for use as the nonionic surfactant of the surfactant systems of the detergent composition, with the polyethylene oxide condensates being preferred. These compounds include the condensation products of alkyl phenols having an alkyl group containing from about 6 to about 14 carbon atoms, preferably from about 8 to about 14 carbon atoms, in either a straight-chain or branched-chain configuration with the alkylene oxide. Commercially available nonionic surfactants of this type include Igepal™ CO-630, marketed by the GAF Corporation; and Triton™ X-45, X-114, X-100 and X-102, all marketed by the Rohm & Haas Company. These surfactants are commonly referred to as alkylphenol alkoxylates (e.g., alkyl phenol ethoxylates).

The condensation products of ethylene oxide with a hydrophobic base formed by the condensation of propylene oxide with propylene glycol are also suitable for use as the additional nonionic surfactant in the detergent composition. The hydrophobic portion of these compounds will preferably have a molecular weight of from about 1500 to about 1800 and will exhibit water insolubility. Examples of compounds of this type include certain of the commercially-available Pluronic™ surfactants, marketed by BASF.

Also suitable for use as a nonionic surfactant in the detergent composition, are the condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic™ compounds, marketed by BASF.

Also preferred nonionics are amine oxide surfactants. The detergent compositions may comprise amine oxide in accordance with the general formula I:

$$R^1(EO)_x(PO)_y(BO)_zN(O)(CH_2R')_2.qH_2O \quad \text{(I).}$$

In general, it can be seen that the structure (I) provides one long-chain moiety $R^1(EO)_x(PO)_y(BO)_z$ and two short chain moieties, $CH_2R'$. R' is preferably selected from hydrogen, methyl and —$CH_2OH$. In general $R^1$ is a primary or branched hydrocarbyl moiety which can be saturated or unsaturated, preferably, $R^1$ is a primary alkyl moiety. When x+y+z=0, $R^1$ is a hydrocarbyl moiety having chainlength of from about 8 to about 18. When x+y+z is different from 0, $R^1$ may be somewhat longer, having a chainlength in the range $C_{12}$–$C_{24}$. The general formula also encompasses amine oxides wherein x+y+z=0, $R_1=C_8$–$C_{18}$, R'=H and q=0–2, preferably 2. These amine oxides are illustrated by $C_{12-14}$ alkyldimethyl amine oxide, hexadecyl dimethylamine oxide, octadecylamine oxide and their hydrates, especially the dihydrates as disclosed in U.S. Pat. Nos. 5,075,501 and 5,071,594, incorporated herein by reference.

(3) Cationic Surfactants:

Nonlimiting examples of cationic surfactants useful herein typically at levels from about 0.1% to about 50%, by weight include the choline ester-type quats and alkoxylated quaternary ammonium (AQA) surfactant compounds, and the like.

Cationic surfactants useful as a component of the surfactant system is a cationic choline ester-type quat surfactant which are preferably water dispersible compounds having surfactant properties and comprise at least one ester (i.e. —COO—) linkage and at least one cationically charged group. Suitable cationic ester surfactants, including choline ester surfactants, have for example been disclosed in U.S. Pat. Nos. 4,228,042, 4,239,660 and 4,260,529.

Preferred cationic ester surfactants are those having the formula:

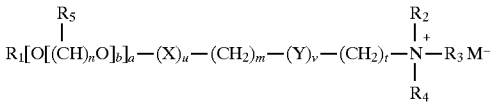

wherein $R_1$ is a $C_5$–$C_{31}$ linear or branched alkyl, alkenyl or alkaryl chain or $M^-$ $N^+(R_6R_7R_8)(CH_2)_s$; X and Y, independtly, are selected from the group consisting of COO, OCO, O, CO, OCOO, CONH, NHCO, OCONH and NHCOO wherein at least one of X or Y is a COO, OCO, OCOO, OCONH or NHCOO group; $R_2$, $R_3$, $R_4$, $R_6$, $R_7$ and $R_8$ are independently selected from the group consisting of alkyl, alkenyl, hydroxyalkyl, hydroxyalkenyl and alkaryl groups having from 1 to 4 carbon atoms; and $R_5$ is independently H or a $C_1$–$C_3$ alkyl group; wherein the values of m, n, s and t independently lie in the range of from 0 to 8, the value of b lies in the range from 0 to 20, and the values of a, u and v independently are either 0 or 1 with the proviso that at least one of u or v must be 1; and wherein M is a counter anion.

Preferably $R_2$, $R_3$ and $R_4$ are independently selected from $CH_3$ and —$CH_2CH_2OH$.

Preferably M is selected from the group consisting of halide, methyl sulfate, sulfate, and nitrate, more preferably methyl sulfate, chloride, bromide or iodide.

Particularly preferred choline esters of this type include the stearoyl choline ester quaternary methylammonium halides ($R^1=C_{17}$ alkyl), palmitoyl choline ester quaternary methylammonium halides ($R^1=C_{15}$ alkyl), myristoyl choline ester quaternary methylammonium halides ($R^1=C_{13}$ alkyl), lauroyl choline ester quaternary methylammonium halides ($R^1=C_{11}$ alkyl), cocoyl choline ester quaternary methylammonium halides ($R^1=C_{11}$–$C_{13}$ alkyl), tallowyl choline ester quaternary methylammonium halides ($R^1=C_{15}$–$C_{17}$ alkyl), and any mixtures thereof.

Cationic surfactants useful herein also include alkoxylated quaternary ammonium (AQA) surfactant compounds (referred to hereinafter as "AQA compounds") having the formula:

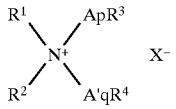

I wherein $R^1$ is a linear or branched alkyl or alkenyl moiety containing from about 8 to about 18 carbon atoms, preferably 10 to about 16 carbon atoms, most preferably from about 10 to about 14 carbon atoms; $R^2$ is an alkyl group containing from one to three carbon atoms, preferably methyl; $R^3$ and $R^4$ can vary independently and are selected from hydrogen (preferred), methyl and ethyl; $X^-$ is an anion such as chloride, bromide, methylsulfate, sulfate, or the like, sufficient to provide electrical neutrality. A and A' can vary independently and are each selected from $C_1$–$C_4$ alkoxy, especially ethoxy (i.e., —$CH_2CH_2O$—), propoxy, butoxy and mixed ethoxy/propoxy; p is from 0 to about 30, preferably 1 to about 4 and q is from 0 to about 30, preferably 1 to about 4, and most preferably to about 4; preferably both p and q are 1. See also: EP 2,084, published May 30, 1979, by The Procter & Gamble Company, which describes cationic surfactants of this type which are also useful herein.

The levels of the AQA surfactants used to prepare finished laundry detergent compositions can range from about 0.1% to about 5%, typically from about 0.45% to about 2.5%, by weight.

The preferred bis-ethoxylated cationic surfactants herein are available under the trade name ETHOQUAD from Akzo Nobel Chemicals Company.

Highly preferred bis-AQA compounds for use herein are of the formula

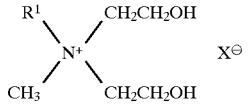

wherein $R^1$ is $C_{10}$–$C_{18}$ hydrocarbyl and mixtures thereof, preferably $C_{10}$, $C_{12}$, $C_{14}$ alkyl and mixtures thereof, and X is any convenient anion to provide charge balance, preferably chloride. With reference to the general AQA structure noted above, since in a preferred compound $R^1$ is derived from coconut ($C_{12}$–$C_{14}$ alkyl) fraction fatty acids, $R^2$ is methyl and $ApR^3$ and $A'qR^4$ are each monoethoxy, this preferred type of compound is referred to herein as "CocoMeEO2" or "AQA-1" in the above list.

Other compounds of the foregoing type include those wherein the ethoxy ($CH_2CH_2O$) units (EO) are replaced by butoxy (Bu), isopropoxy [$CH(CH_3)CH_2O$] and [$CH_2CH(CH_3O$] units (i-Pr) or n-propoxy units (Pr), or mixtures of EO and/or Pr and/or i-Pr units.

Additional cationic surfactants are described, for example, in the "Surfactant Science Series, Volume 4, Cationic Surfactants" or in the "Industrial Surfactants Handbook". Classes of useful cationic surfactants described in these references include amide quats (i.e., Lexquat AMG & Schercoquat CAS), glycidyl ether quats (i.e., Cyostat 609), hydroxyalkyl quats (i.e., Dehyquart E), alkoxypropyl quats (i.e., Tomah Q-17-2), polypropoxy quats (Emcol CC-9), cyclic alkylammonium compounds (i.e., pyridinium or imidazolinium quats), and/or benzalkonium quats.

Typical cationic fabric softening components include the water-insoluble quaternary-ammonium fabric softening actives or their corresponding amine precursor, the most commonly used having been di-long alkyl chain ammonium chloride or methyl sulfate.

Preferred cationic softeners among these include the following:

1) ditallow dimethylammonium chloride (DTDMAC);
2) dihydrogenated tallow dimethylammonium chloride;
3) dihydrogenated tallow dimethylammonium methylsulfate;
4) distearyl dimethylammonium chloride;
5) dioleyl dimethylammonium chloride;
6) dipalmityl hydroxyethyl methylammonium chloride;
7) stearyl benzyl dimethylammonium chloride;
8) tallow trimethylammonium chloride;
9) hydrogenated tallow trimethylammonium chloride;
10) $C_{12-14}$ alkyl hydroxyethyl dimethylammonium chloride;
11) $C_{12-18}$ alkyl dihydroxyethyl methylammonium chloride;
12) di(stearoyloxyethyl) dimethylammonium chloride (DSOEDMAC);
13) di(tallow-oxy-ethyl) dimethylammonium chloride;
14) ditallow imidazolinium methylsulfate;
15) 1-(2-tallowylamidoethyl)-2-tallowyl imidazolinium methylsulfate.

Biodegradable quaternary ammonium compounds have been presented as alternatives to the traditionally used di-long alkyl chain ammonium chlorides and methyl sulfates. Such quaternary ammonium compounds contain long chain alk(en)yl groups interrupted by functional groups such as carboxy groups. Said materials and fabric softening compositions containing them are disclosed in numerous publications such as EP-A-0,040,562, and EP-A-0,239,910.

The quaternary ammonium compounds and amine precursors herein have the formula (I) or (II), below

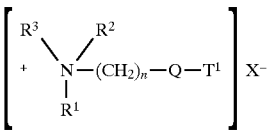

(I)

or

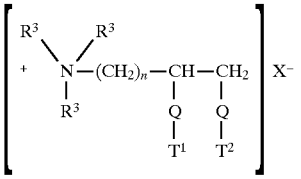

(II)

wherein Q is selected from —O—C(O)—, —C(O)—O—, —O—C(O)—O—, —$NR^4$—C(O)—, —C(O)—$NR^4$—;

$R^1$ is $(CH_2)_n$—Q—$T^2$ or $T^3$;

$R^2$ is $(CH_2)_m$—Q—$T^4$ or $T^5$ or $R^3$;

$R^3$ is $C_1$–$C_4$ alkyl or $C_1$–$C_4$ hydroxyalkyl or H;

$R^4$ is H or $C_1$–$C_4$ alkyl or $C_1$–$C_4$ hydroxyalkyl;

$T^1$, $T^2$, $T^3$, $T^4$, $T^5$ are independently $C_{11}$–$C_{22}$ alkyl or alkenyl; n and m are integers from 1 to 4; and $X^-$ is a softener-compatible anion. Non-limiting examples of softener-compatible anions include chloride or methyl sulfate.

The alkyl, or alkenyl, chain $T^1$, $T^2$, $T^3$, $T^4$, $T^5$ must contain at least 11 carbon atoms, preferably at least 16 carbon atoms. The chain may be straight or branched. Tallow is a convenient and inexpensive source of long chain alkyl and alkenyl material. The compounds wherein $T^1$, $T^2$, $T^3$, $T^4$, $T^5$ represents the mixture of long chain materials typical for tallow are particularly preferred.

Specific examples of quaternary ammonium compounds suitable for use in the aqueous fabric softening compositions herein include:

1) N,N-di(tallowyl-oxy-ethyl)-N,N-dimethyl ammonium chloride;
2) N,N-di(tallowyl-oxy-ethyl)-N-methyl, N-(2-hydroxyethyl) ammonium methyl sulfate;
3) N,N-di(2-tallowyl-oxy-2-oxo-ethyl)-N,N-dimethyl ammonium chloride;
4) N,N-di(2-tallowyl-oxy-ethylcarbonyl-oxy-ethyl)-N,N-dimethyl ammonium chloride;
5) N-(2-tallowyl-oxy-2-ethyl)-N-(2-tallowyl-oxy-2-oxo-ethyl)-N,N-dimethyl ammonium chloride;
6) N,N,N-tri(tallowyl-oxy-ethyl)-N-methyl ammonium chloride;
7) N-(2-tallowyl-oxy-2-oxo-ethyl)-N-(tallowyl-N,N-dimethyl-ammonium chloride; and
8) 1,2-ditallowyl-oxy-3-trimethylammoniopropane chloride; and mixtures of any of the above materials.

Other conventional useful surfactants are listed in standard texts.

2. Builders

Detergent builders can optionally be included in the detergent compositions herein to assist in controlling mineral hardness. Inorganic as well as organic builders can be used. Builders are typically used in fabric laundering compositions to assist in the removal of particulate soils.

The level of builder can vary widely depending upon the end use of the composition and its desired physical form. When present, the compositions will typically comprise at least about 1% builder. Liquid formulations typically comprise from about 5% to about 50%, more typically about 5% to about 30%, by weight, of detergent builder. Granular formulations typically comprise from about 10% to about 80%, more typically from about 15% to about 50% by weight, of the detergent builder. Lower or higher levels of builder, however, are not meant to be excluded.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the detergent composition. Aluminosilicate builders are of great importance in most currently marketed heavy duty granular detergent compositions, and can also be a significant builder ingredient in liquid detergent formulations. Aluminosilicate builders include those having the empirical formula:

$$M_z(zAlO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. Preferred synthetic crystalline aluminosilicate ion exchange materials useful herein are available under the designations Zeolite A, Zeolite P (B), Zeolite MAP and Zeolite X. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the detergent composition include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions are the 3,3-dicarboxy-4-oxa-1,6-hexanedioates and the related compounds disclosed in U.S. Pat. No. 4,566,984 to Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also U.S. Pat. No. 3,723,322 to Diehl, issued Mar. 27, 1973.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581 to Diehl, issued Dec. 1, 1964; 3,213,030 to Diehl, issued Oct. 19, 1965; 3,400,148 to Quimby, issued Sep. 3, 1968; 3,422,021 to Roy, issued Jan. 14, 1969; and 3,422,137 to Quimby, issued Jan. 14, 1969) can also be used.

3. Alkoxylated Polycarboxylates

Alkoxylated polycarboxylates such as those prepared from polyacrylates are useful herein to provide additional grease removal performance. Such materials are described in WO 91/08281 and PCT 90/01815 at p. 4 et seq. Chemically, these materials comprise polyacrylates having one ethoxy side-chain per every 7–8 acrylate units. The side-chains are of the formula $—(CH_2CH_2O)_m(CH_2)_nCH_3$ wherein m is 2–3 and n is 6–12. The side-chains are ester-linked to the polyacrylate "backbone" to provide a "comb" polymer type structure. The molecular weight can vary, but is typically in the range of about 2000 to about 50,000. Such alkoxylated polycarboxylates can comprise from about 0.05% to about 10% of the compositions herein.

4. Bleaching Compounds—Bleaching Agents and Bleach Activators

The detergent compositions herein may optionally contain bleaching agents or bleaching compositions containing a bleaching agent and one or more bleach activators. When present, bleaching agents will typically be at levels of from about 1% to about 30%, more typically from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

(1) Oxygen Bleaching Agents:

Preferred detergent compositions comprise, as part or all of the laundry or cleaning adjunct materials, an oxygen bleaching agent. Oxygen bleaching agents useful in the detergent composition can be any of the oxidizing agents known for laundry, hard surface cleaning, automatic dishwashing or denture cleaning purposes. Oxygen bleaches or mixtures thereof are preferred, though other oxidant bleaches, such as oxygen, an enzymatic hydrogen peroxide producing system, or hypohalites such as chlorine bleaches like hypochlorite, may also be used.

Oxygen bleaches deliver "available oxygen" (AvO) or "active oxygen" which is typically measurable by standard methods such as iodide/thiosulfate and/or ceric sulfate titration. See the well-known work by Swern, or Kirk Othmer's Encyclopedia of Chemical Technology under "Bleaching Agents". When the oxygen bleach is a peroxygen compound, it contains —O—O— linkages with one O in each such linkage being "active". AvO content of such an oxygen bleach compound, usually expressed as a percent, is equal to 100* the number of active oxygen atoms * (16/molecular weight of the oxygen bleach compound).

Preferably, an oxygen bleach will be used herein, since this benefits directly from combination with the transition-metal bleach catalyst. The oxygen bleach herein can have any physical form compatible with the intended application; more particularly, liquid-form and solid-form oxygen bleaches as well as adjuncts, promoters or activators are included. Liquids can be included in solid detergents, for example by adsorption onto an inert support; and solids can be included in liquid detergents, for example by use of compatible suspending agents.

Common oxygen bleaches of the peroxygen type include hydrogen peroxide, inorganic peroxohydrates, organic peroxohydrates and the organic peroxyacids, including hydrophilic and hydrophobic mono- or di- peroxyacids. These can be peroxycarboxylic acids, peroxyimidic acids, amidoperoxycarboxylic acids, or their salts including the calcium, magnesium, or mixed-cation salts. Peracids of various kinds can be used both in free form and as precursors known as "bleach activators" or "bleach promoters" which, when combined with a source of hydrogen peroxide, perhydrolyze to release the corresponding peracid.

Also useful herein as oxygen bleaches are the inorganic peroxides such as $Na_2O_2$, superoxides such as $KO_2$, organic hydroperoxides such as cumene hydroperoxide and t-butyl hydroperoxide, and the inorganic peroxoacids and their salts such as the peroxosulfuric acid salts, especially the potassium salts of peroxodisulfuric acid and, more preferably, of peroxomonosulfuric acid including the commercial triple-salt form sold as OXONE by DuPont and also any equivalent commercially available forms such as CUROX from Akzo or CAROAT from Degussa. Certain organic peroxides, such as dibenzoyl peroxide, may be useful, especially as additives rather than as primary oxygen bleach.

Mixed oxygen bleach systems are generally useful, as are mixtures of any oxygen bleaches with the known bleach activators, organic catalysts, enzymatic catalysts and mixtures thereof; moreover such mixtures may further include brighteners, photobleaches and dye transfer inhibitors of types well-known in the art.

Preferred oxygen bleaches, as noted, include the peroxohydrates, sometimes known as peroxyhydrates or peroxohydrates. These are organic or, more commonly, inorganic salts capable of releasing hydrogen peroxide readily. They include types in which hydrogen peroxide is present as a true crystal hydrate, and types in which hydrogen peroxide is incorporated covalently and is released chemically, for example by hydrolysis. Typically, peroxohydrates deliver hydrogen peroxide readily enough that it can be extracted in measurable amounts into the ether phase of an ether/water mixture. Peroxohydrates are characterized in that they fail to give the Riesenfeld reaction, in contrast to certain other oxygen bleach types described hereinafter. Peroxohydrates are the most common examples of "hydrogen peroxide source" materials and include the perborates, percarbonates, perphosphates, and persilicates. Other materials which serve to produce or release hydrogen peroxide are, of course, useful. Mixtures of two or more peroxohydrates can be used, for example when it is desired to exploit differential solubility. Suitable peroxohydrates include sodium carbonate peroxyhydrate and equivalent commercial "percarbonate" bleaches, and any of the so-called sodium perborate hydrates, the "tetrahydrate" and "monohydrate" being preferred; though sodium pyrophosphate peroxyhydrate can be used. Many such peroxohydrates are available in processed forms with coatings, such as of silicate and/or borate and/or waxy materials and/or surfactants, or have particle geometries, such as compact spheres, which improve storage stability. By way of organic peroxohydrates, urea peroxyhydrate can also be useful herein.

Percarbonate bleach includes, for example, dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Percarbonates and perborates are widely available in commerce, for example from FMC, Solvay and Tokai Denka.

Organic percarboxylic acids useful herein as the oxygen bleach include magnesium monoperoxyphthalate hexahydrate, available from Interox, m-chloro perbenzoic acid and its salts, 4-nonylamino-4-oxoperoxybutyric acid and diperoxydodecanedioic acid and their salts. Such bleaching agents are disclosed in U.S. Pat. No. 4,483,781, Hartman, issued Nov. 20, 1984, U.S. patent application Ser. No. 740,446, Burns et al, filed Jun. 3, 1985, European Patent Application Ser. No. 0,133,354, Banks et al, published Feb. 20, 1985, and U.S. Pat. No. 4,412,934, Chung et al, issued Nov. 1, 1983. Highly preferred oxygen bleaches also include 6-nonylamino-6-oxoperoxycaproic acid (NAPAA) as described in U.S. Pat. No. 4,634,551, issued Jan. 6, 1987 to Burns et al, and include those having formula HO—O—C(O)—R—Y wherein R is an alkylene or substituted alkylene group containing from 1 to about 22 carbon atoms or a phenylene or substituted phenylene group, and Y is hydrogen, halogen, alkyl, aryl or —C(O)—OH or —C(O)—O—OH.

Organic percarboxylic acids usable herein include those containing one, two or more peroxy groups, and can be aliphatic or aromatic. When the organic percarboxylic acid is aliphatic, the unsubstituted acid suitably has the linear formula: HO—O—C(O)—$(CH_2)_n$—Y where Y can be, for example, H, $CH_3$, $CH_2Cl$, COOH, or C(O)OOH; and n is an integer from 1 to 20. Branched analogs are also acceptable. When the organic percarboxylic acid is aromatic, the unsubstituted acid suitably has formula: HO—O—C(O)—$C_6H_4$—Y wherein Y is hydrogen, alkyl, alkyhalogen, halogen, or —COOH or —C(O)OOH.

Monoperoxycarboxylic acids useful as oxygen bleach herein are further illustrated by alkyl percarboxylic acids and aryl percarboxylic acids such as peroxybenzoic acid and ring-substituted peroxybenzoic acids, e.g., peroxy-alpha-naphthoic acid; aliphatic, substituted aliphatic and arylalkyl monoperoxy acids such as peroxylauric acid, peroxystearic acid, and N,N-phthaloylaminoperoxycaproic acid (PAP); and 6-octylamino-6-oxo-peroxyhexanoic acid. Monoperoxycarboxylic acids can be hydrophilic, such as peracetic acid, or can be relatively hydrophobic. The hydrophobic types include those containing a chain of six or more carbon atoms, preferred hydrophobic types having a linear aliphatic C8-C14 chain optionally substituted by one or more ether oxygen atoms and/or one or more aromatic moieties positioned such that the peracid is an aliphatic peracid. More generally, such optional substitution by ether oxygen atoms and/or aromatic moieties can be applied to any of the peracids or bleach activators herein. Branched-chain peracid types and aromatic peracids having one or more C3-C16 linear or branched long-chain substituents can also be useful. The peracids can be used in the acid form or as any suitable salt with a bleach-stable cation. Very useful herein are the organic percarboxylic acids of formula:

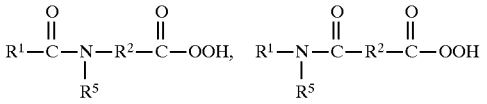

or mixtures thereof wherein $R^1$ is alkyl, aryl, or alkaryl containing from about 1 to about 14 carbon atoms, $R^2$ is alkylene, arylene or alkarylene containing from about 1 to about 14 carbon atoms, and $R^5$ is H or alkyl, aryl, or alkaryl containing from about 1 to about 10 carbon atoms. When these peracids have a sum of carbon atoms in $R^1$ and $R^2$ together of about 6 or higher, preferably from about 8 to about 14, they are particularly suitable as hydrophobic peracids for bleaching a variety of relatively hydrophobic or "lipophilic" stains, including so-called "dingy" types. Calcium, magnesium, or substituted ammonium salts may also be useful.

Other useful peracids and bleach activators herein are in the family of imidoperacids and imido bleach activators. These include phthaloylimidoperoxycaproic acid and related arylimido-substituted and acyloxynitrogen derivatives. For listings of such compounds, preparations and their incorporation into laundry compositions including both granules and liquids, See U.S. Pat. No. 5,487,818; U.S. Pat. No. 5,470,988, U.S. Pat. No. 5,466,825; U.S. Pat. No. 5,419,846; U.S. Pat. No. 5,415,796; U.S. Pat. No. 5,391,324; U.S Pat. No. 5,328,634; U.S. Pat. No. 5,310,934; U.S. Pat. No. 5,279,757; U.S. Pat. No. 5,246,620; U.S. Pat. No. 5,245,075; U.S. Pat. No. 5,294,362; U.S. Pat. No. 5,423,998; U.S. Pat. No. 5,208,340; U.S. Pat. No. 5,132,431 and U.S. Pat. No. 5,087,385.

Useful diperoxyacids include, for example, 1,12-diperoxydodecanedioic acid (DPDA); 1,9-diperoxyazelaic acid; diperoxybrassilic acid; diperoxysebasic acid and diperoxyisophthalic acid; 2-decyidiperoxybutane-1,4-dioic acid; and 4,4'-sulphonylbisperoxybenzoic acid. Owing to structures in which two relatively hydrophilic groups are disposed at the ends of the molecule, diperoxyacids have sometimes been classified separately from the hydrophilic and hydrophobic monoperacids, for example as "hydrotropic". Some of the diperacids are hydrophobic in a quite literal sense, especially when they have a long-chain moiety separating the peroxyacid moieties.

More generally, the terms "hydrophilic" and "hydrophobic" used herein in connection with any of the oxygen bleaches, especially the peracids, and in connection with bleach activators, are in the first instance based on whether a given oxygen bleach effectively performs bleaching of fugitive dyes in solution thereby preventing fabric graying and discoloration and/or removes more hydrophilic stains such as tea, wine and grape juice—in this case it is termed "hydrophilic". When the oxygen bleach or bleach activator has a significant stain removal, whiteness-improving or cleaning effect on dingy, greasy, carotenoid, or other hydrophobic soils, it is termed "hydrophobic". The terms are applicable also when referring to peracids or bleach activators used in combination with a hydrogen peroxide source. The current commercial benchmarks for hydrophilic performance of oxygen bleach systems are: TAED or peracetic acid, for benchmarking hydrophilic bleaching. NOBS or NAPAA are the corresponding benchmarks for hydrophobic bleaching. The terms "hydrophilic", "hydrophobic" and "hydrotropic" with reference to oxygen bleaches including peracids and here extended to bleach activator have also been used somewhat more narrowly in the literature. See especially Kirk Othmer's Encyclopedia of Chemical Technology, Vol. 4., pages 284–285. This reference provides a chromatographic retention time and critical micelle concentration-based set of criteria, and is useful to identify and/or characterize preferred sub-classes of hydrophobic, hydrophilic and hydrotropic oxygen bleaches and bleach activators that can be used in the detergent composition.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain from about 0.025% to about 1.25%, by weight, of such bleaches, especially sulfonate zinc phthalocyanine.

(2) Enzymatic sources of hydrogen peroxide

On a different track from the bleach activators illustrated hereinabove, another suitable hydrogen peroxide generating system is a combination of a $C_1$–$C_4$ alkanol oxidase and a $C_1$–$C_4$ alkanol, especially a combination of methanol oxidase (MOX) and ethanol. Such combinations are disclosed in WO 94/03003. Other enzymatic materials related to bleaching, such as peroxidases, haloperoxidases, oxidases, superoxide dismutases, catalases and their enhancers or, more commonly, inhibitors, may be used as optional ingredients in the instant compositions.

(3) Oxygen Transfer Agents and Precursors

Also useful herein are any of the known organic bleach catalysts, oxygen transfer agents or precursors therefor. These include the compounds themselves and/or their precursors, for example any suitable ketone for production of dioxiranes and/or any of the hetero-atom containing analogs of dioxirane precursors or dioxiranes, such as sulfonimines $R^1R^2C{=}NSO_2R^3$, see EP 446 982 A, published 1991 and sulfonyloxaziridines, for example:

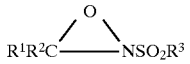

see EP 446,981 A, published 1991. Preferred examples of such materials include hydrophilic or hydrophobic ketones, used especially in conjunction with monoperoxysulfates to produce dioxiranes in situ, and/or the imines described in U.S. Pat. No. 5,576,282 and references described therein. Oxygen bleaches preferably used in conjunction with such oxygen transfer agents or precursors include percarboxylic acids and salts, percarbonic acids and salts, peroxymonosulfuric acid and salts, and mixtures thereof. See also U.S. Pat. No. 5,360,568; U.S. Pat. No. 5,360,569; and U.S. Pat. No. 5,370,826. In a highly preferred embodiment, the detergent composition incorporates a transition-metal bleach catalyst and an organic bleach catalyst such as one named hereinabove, a primary oxidant such as a hydrogen peroxide source, and at least one additional detergent, hard-surface cleaner or automatic dishwashing adjunct. Preferred among such compositions are those which further include a precursor for a hydrophobic oxygen bleach, such as NOBS.

Although oxygen bleach systems and/or their precursors may be susceptible to decomposition during storage in the presence of moisture, air (oxygen and/or carbon dioxide) and trace metals (especially rust or simple salts or colloidal oxides of the transition metals) and when subjected to light, stability can be improved by adding common sequestrants (chelants) and/or polymeric dispersants and/or a small amount of antioxidant to the bleach system or product. See, for example, U.S. Pat. No. 5,545,349. Antioxidants are often added to detergent ingredients ranging from enzymes to surfactants. Their presence is not necessarily inconsistent with use of an oxidant bleach; for example, the introduction of a phase barrier may be used to stabilize an apparently incompatible combination of an enzyme and antioxidant, on one hand, and an oxygen bleach, on the other. Although commonly known substances can be used as antioxidants, those that are preferable include phenol-based antioxidants such as 3,5-di-tert-butyl-4-hydroxytoluene and 2,5-di-tert-butylhydroquinone; amine-based antioxidants such as N,N'-diphenyl-p-phenylenediamine and phenyl-4-piperizinyl-carbonate; sulfur-based antioxidants such as didodecyl-3,3'-thiodipropionate and ditridecyl-3,3'-thiodipropionate; phosphorus-based antioxidants such as tris(isodecyl) phosphate and triphenylphosphate; and, natural antioxidants such as L-ascorbic acid, its sodium salts and DL-alpha -tocopherol. These antioxidants may be used independently or in combinations of two or more. From among these, 3,5-di-tert-butyl-4-hydroxytoluene, 2,5-di-tert-butylhydroquinone and D,L-alpha -tocopherol are particularly preferable. When used, antioxidants are blended into the bleaching composition preferably at a proportion of 0.01–1.0 wt % of the organic acid peroxide precursor, and particularly preferably at a proportion of 0.05–0.5 wt %. The hydrogen peroxide or peroxide that produces hydrogen peroxide in aqueous solution is blended into the mixture during use preferably at a proportion of 0.5–98 wt %, and particularly preferably at a proportion of 1–50 wt %, so that the effective oxygen concentration is preferably 0.1–3 wt %, and particularly preferably 0.2–2 wt %. In addition, the organic acid peroxide precursor is blended into the composition during use, preferably at a proportion of 0.1–50 wt % and particularly preferably at a proportion of 0.5–30 wt %. Without intending to be limited by theory, antioxidants operating to inhibit or shut down free radical mechanisms may be particularly desirable for controlling fabric damage.

While the combinations of ingredients used with the transition-metal bleach catalysts can be widely permuted, some particularly preferred combinations include:

(a) transition metal bleach catalyst+hydrogen peroxide source alone, e.g., sodium perborate or percarbonate;

(b) as (a) but with the further addition of a bleach activator selected from
  (i) hydrophilic bleach activators, such as TAED;
  (ii) hydrophobic bleach activators, such as NOBS or activators capable, on perhydrolysis, of releasing NAPAA or a similar hydrophobic peracid, and
  (iii) mixtures thereof;

(c) transition metal bleach catalyst+peracid alone, e.g.,
  (i) hydrophilic peracid, e.g., peracetic acid;
  (ii) hydrophobic peracid, e.g., NAPAA or peroxylauric acid;
  (iii) inorganic peracid, e.g., peroxymonosulfuric acid potassium salts;

(d) use (a), (b) or (c) with the further addition of an oxygen transfer agent or precursor therefor; especially (c)+oxygen transfer agent.

Any of (a)–(d) can be further combined with one or more detersive surfactants, especially including mid-chain branched anionic types having superior low-temperature solubility, such as mid-chain branched sodium alkyl sulfates, though high-level incorporation of nonionic detersive surfactants is also very useful, especially in compact-form heavy-duty granular detergent embodiments; polymeric dispersants, especially including biodegradable, hydrophobically modified and/or terpolymeric types; sequestrants, for example certain penta(methylenephosphonates) or ethylenediamine disuccinate; fluorescent whitening agents; enzymes, including those capable of generating hydrogen peroxide; photobleaches; and/or dye transfer inhibitors. Conventional builders, buffers or alkalis and combinations of multiple cleaning-promoting enzymes, especially proteases, cellulases, amylases, keratinases, and/or lipases may also be added. In such combinations, the transition metal bleach catalyst will preferably be at levels in a range suited to provide wash (in-use) concentrations of from about 0.1 to about 10 ppm (weight of catalyst); the other components typically being used at their known levels, which may vary widely.

While there is currently no certain advantage, the transition metal catalysts can be used in combination with heretofore-disclosed transition metal bleach or dye transfer inhibition catalysts, such as the Mn or Fe complexes of triazacyclononanes, the Fe complexes of N,N-bis(pyridin-2-yl-methyl)-bis(pyridin-2-yl)methylamine (U.S. Pat. No. 5,580,485) and the like. For example, when the transition metal bleach catalyst is one disclosed to be particularly effective for solution bleaching and dye transfer inhibition, as is the case for example with certain transition metal complexes of porphyrins, it may be combined with one better suited for promoting interfacial bleaching of soiled substrates.

(4) Bleach Activators

Bleach activators useful herein include amides, imides, esters and anhydrides. Commonly at least one substituted or unsubstituted acyl moiety is present, covalently connected to a leaving group as in the structure R—C(O)—L. In one preferred mode of use, bleach activators are combined with a source of hydrogen peroxide, such as the perborates or percarbonates, in a single product. Conveniently, the single product leads to in situ production in aqueous solution (i.e., during the washing process) of the percarboxylic acid corresponding to the bleach activator. The product itself can be hydrous, for example a powder, provided that water is controlled in amount and mobility such that storage stability is acceptable. Alternately, the product can be an anhydrous solid or liquid. In another mode, the bleach activator or oxygen bleach is incorporated in a pretreatment product, such as a stain stick; soiled, pretreated substrates can then be exposed to further treatments, for example of a hydrogen peroxide source. With respect to the above bleach activator structure RC(O)L, the atom in the leaving group connecting to the peracid-forming acyl moiety R(C)O— is most typically O or N. Bleach activators can have non-charged, positively or negatively charged peracid-forming moieties and/or noncharged, positively or negatively charged leaving groups. One or more peracid-forming moieties or leaving-groups can be present. See, for example, U.S. Pat. No. 5,595,967, U.S. Pat. No. 5,561,235, U.S. Pat. No. 5,560,862 or the bis-(peroxy-carbonic) system of U.S. Pat. No. 5,534,179. Bleach activators can be substituted with electron-donating or electron-releasing moieties either in the leaving-group or in the peracid-forming moiety or moieties, changing their reactivity and making them more or less suited to particular pH or wash conditions. For example, electron-withdrawing groups such as $NO_2$ improve the efficacy of bleach activators intended for use in mild-pH (e.g., from about 7.5–to about 9.5) wash conditions.

Cationic bleach activators include quaternary carbamate-, quaternary carbonate-, quaternary ester- and quaternary amide- types, delivering a range of cationic peroxyimidic, peroxycarbonic or peroxycarboxylic acids to the wash. An analogous but non-cationic palette of bleach activators is available when quaternary derivatives are not desired. In more detail, cationic activators include quaternary ammonium-substituted activators of WO 96-06915, U.S. Pat. Nos. 4,751,015 and 4,397,757, EP-A-284292, EP-A-331,229 and EP-A-03520 including 2-(N,N,N-trimethyl ammonium) ethyl-4-sulphophenyl carbonate-(SPCC); N-octyl,N,N-dimethyl-N 10-carbophenoxy decyl ammonium chloride-(ODC); 3-(N,N,N-trimethyl ammonium) propyl sodium-4-sulphophenyl carboxylate; and N,N,N-trimethyl ammonium toluyloxy benzene sulfonate. Also useful are cationic nitriles as disclosed in EP-A-303,520 and in European Patent Specification 458,396 and 464,880. Other nitrile types have electron-withdrawing substituents as described in U.S. Pat. No. 5,591,378; examples including 3,5-dimethoxybenzonitrile and 3,5-dinitrobenzonitrile.

Other bleach activator disclosures include GB 836,988; 864,798; 907,356; 1,003,310 and 1,519,351; German Patent 3,337,921; EP-A-0185522; EP-A-0174132; EP-A-0120591; U.S. Pat. Nos. 1,246,339; 3,332,882; 4,128,494; 4,412,934 and 4,675,393, and the phenol sulfonate ester of alkanoyl aminoacids disclosed in U.S. Pat. No. 5,523,434. Suitable bleach activators include any acetylated diamine types, whether hydrophilic or hydrophobic in character.

Of the above classes of bleach precursors, preferred classes include the esters, including acyl phenol sulfonates, acyl alkyl phenol sulfonates or acyl oxybenzenesulfonates (OBS leaving-group); the acyl-amides; and the quaternary ammonium substituted peroxyacid precursors including the cationic nitriles.

Preferred bleach activators include N,N,N'N'-tetraacetyl ethylene diamine (TAED) or any of its close relatives including the triacetyl or other unsymmetrical derivatives. TAED and the acetylated carbohydrates such as glucose pentaacetate and tetraacetyl xylose are preferred hydrophilic bleach activators. Depending on the application, acetyl triethyl citrate, a liquid, also has some utility, as does phenyl benzoate.

Preferred hydrophobic bleach activators include sodium nonanoyloxybenzene sulfonate (NOBS or SNOBS), substituted amide types described in detail hereinafter, such as activators related to NAPAA, and activators related to certain imidoperacid bleaches, for example as described in U.S. Pat. No. 5,061,807, issued Oct. 29, 1991 and assigned to Hoechst Aktiengesellschaft of Frankfurt, Germany. Japanese Laid-Open Patent Application (Kokai) No. 4-28799 for example describes a bleaching agent and a bleaching detergent composition comprising an organic peracid precursor described by a general formula and illustrated by compounds which may be summarized more particularly as conforming to the formula:

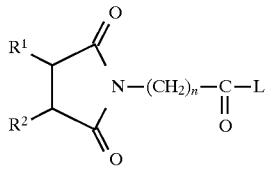

wherein L is sodium p-phenolsulfonate, $R^1$ is $CH_3$ or $C_{12}H_{25}$ and $R^2$ is H.

Analogs of these compounds having any of the leaving-groups identified herein and/or having RI being linear or branched C6-C16 are also useful.

Another group of peracids and bleach activators herein are those derivable from acyclic imidoperoxycarboxylic acids and salts thereof of the formula:

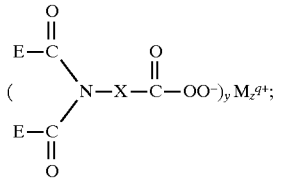

(i)

cyclic imidoperoxycarboxylic acids and salts thereof of the formula:

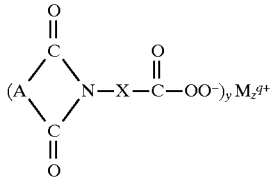

(ii)

and (iii) mixtures of said compounds, (i) and (ii); wherein M is selected from hydrogen and bleach-compatible cations having charge q; and y and z are integers such that said compound is electrically neutral; E, A and X comprise hydrocarbyl groups; and said terminal hydrocarbyl groups are contained within E and A. The structure of the corresponding bleach activators is obtained by deleting the peroxy moiety and the metal and replacing it with a leaving-group L, which can be any of the leaving-group moieties defined elsewhere herein. In preferred embodiments, there are encompassed detergent compositions wherein, in any of said compounds, X is linear $C_3$–$C_8$ alkyl; A is selected from:

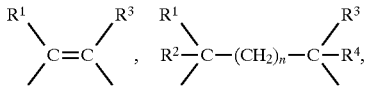

wherein n is from 0 to about 4, and

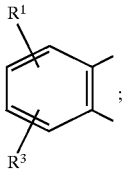

wherein $R^1$ and E are said terminal hydrocarbyl groups, $R^2$, $R^3$ and $R^4$ are independently selected from H, $C_1$–$C_3$ saturated alkyl, and $C_1$–$C_3$ unsaturated alkyl; and wherein said terminal hydrocarbyl groups are alkyl groups comprising at least six carbon atoms, more typically linear or branched alkyl having from about 8 to about 16 carbon atoms.

Other suitable bleach activators include sodium-4-benzoyloxy benzene sulfonate (SBOBS); sodium-1-methyl-2-benzoyloxy benzene-4-sulphonate; sodium-4-methyl-3-benzoyloxy benzoate (SPCC); trimethyl ammonium toluyloxy-benzene sulfonate; or sodium 3,5,5-trimethyl hexanoyloxybenzene sulfonate (STHOBS).

Bleach activators may be used in an amount of up to 20%, preferably from 0.1–10% by weight, of the composition, though higher levels, 40% or more, are acceptable, for example in highly concentrated bleach additive product forms or forms intended for appliance automated dosing.

Highly preferred bleach activators useful herein are amide-substituted and have either of the formulae:

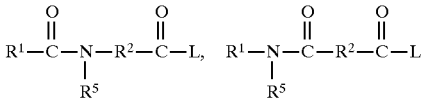

or mixtures thereof, wherein $R^1$ is alkyl, aryl, or alkaryl containing from about 1 to about 14 carbon atoms including both hydrophilic types (short $R^1$) and hydrophobic types ($R^1$ is especially from about 8 to about 12), $R^2$ is alkylene, arylene or alkarylene containing from about 1 to about 14 carbon atoms, $R^5$ is H, or an alkyl, aryl, or alkaryl containing from about 1 to about 10 carbon atoms, and L is a leaving group.

A leaving group as defined herein is any group that is displaced from the bleach activator as a consequence of attack by perhydroxide or equivalent reagent capable of liberating a more potent bleach from the reaction. Perhydrolysis is a term used to describe such reaction. Thus bleach activators perhydrolyze to liberate peracid. Leaving groups of bleach activators for relatively low-pH washing are suitably electron-withdrawing. Preferred leaving groups have slow rates of reassociation with the moiety from which they have been displaced. Leaving groups of bleach activators are preferably selected such that their removal and peracid formation are at rates consistent with the desired application, e.g., a wash cycle. In practice, a balance is struck such that leaving-groups are not appreciably liberated, and the corresponding activators do not appreciably hydrolyze or perhydrolyze, while stored in a bleaching composition. The pK of the conjugate acid of the leaving group is a measure of suitability, and is typically from about 4 to about 16, or higher, preferably from about 6 to about 12, more preferably from about 8 to about 11.

Preferred bleach activators include those of the formulae, for example the amide-substituted formulae, hereinabove, wherein $R^1$, $R^2$ and $R^5$ are as defined for the corresponding peroxyacid and L is selected from the group consisting of:

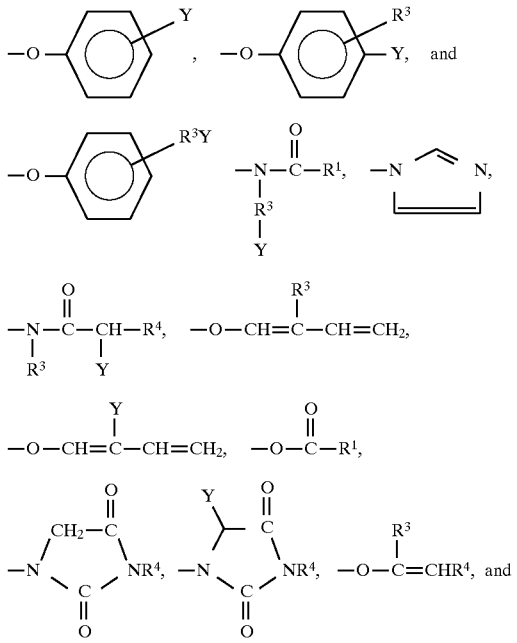

-continued

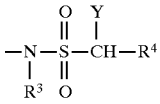

and mixtures thereof, wherein $R^1$ is a linear or branched alkyl, aryl, or alkaryl group containing from about 1 to about 14 carbon atoms, $R^3$ is an alkyl chain containing from 1 to about 8 carbon atoms, $R^4$ is H or $R^3$, and Y is H or a solubilizing group. These and other known leaving groups are, more generally, general suitable alternatives for introduction into any bleach activator herein. Preferred solubilizing groups include —SO3⁻M⁺, —CO2⁻M⁺, —SO4⁻M⁺, —N⁺(R) 4X⁻ and O←N($R^3$)2, more preferably —SO3⁻M⁺ and —CO2⁻M⁺ wherein $R^3$ is an alkyl chain containing from about 1 to about 4 carbon atoms, M is a bleachstable cation and X is a bleach-stable anion, each of which is selected consistent with maintaining solubility of the activator. Under some circumstances, for example solid-form European heavy-duty granular detergents, any of the above bleach activators are preferably solids having crystalline character and melting-point above about 50 deg. C; in these cases, branched alkyl groups are preferably not included in the oxygen bleach or bleach activator; in other formulation contexts, for example heavy-duty liquids with bleach or liquid bleach additives, low-melting or liquid bleach activators are preferred. Melting-point reduction can be favored by incorporating branched, rather than linear alkyl moieties into the oxygen bleach or precursor.

When solubilizing groups are added to the leaving group, the activator can have good water-solubility or dispersibility while still being capable of delivering a relatively hydrophobic peracid. Preferably, M is alkali metal, ammonium or substituted ammonium, more preferably Na or K, and X is halide, hydroxide, methylsulfate or acetate. Solubilizing groups can, more generally, be used in any bleach activator herein. Bleach activators of lower solubility, for example those with leaving group not having a solubilizing group, may need to be finely divided or dispersed in bleaching solutions for acceptable results.

Preferred bleach activators also include those of the above general formula wherein L is selected from the group consisting of:

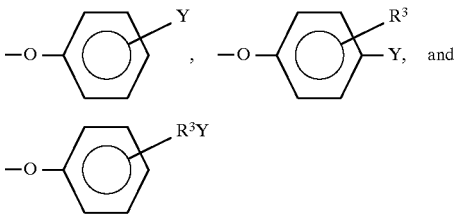

wherein $R^3$ is as defined above and Y is —SO3⁻M⁺ or —CO2⁻M⁺ wherein M is as defined above.

Preferred examples of bleach activators of the above formulae include:

(6-octanamidocaproyl)oxybenzenesulfonate, (6-nonanamidocaproyl)oxybenzenesulfonate, (6-decanamidocaproyl)oxybenzenesulfonate, and mixtures thereof.

Other useful activators, disclosed in U.S. Pat. No. 4,966,723, are benzoxazin-type, such as a $C_6H_4$ ring to which is fused in the 1,2-positions a moiety ——C(O)OC($R^1$)═N—.

Depending on the activator and precise application, good bleaching results can be obtained from bleaching systems having with in-use pH of from about 6 to about 13, preferably from about 9.0 to about 10.5. Typically, for example, activators with electron-withdrawing moieties are used for near-neutral or sub-neutral pH ranges. Alkalis and buffering agents can be used to secure such pH.

Acyl lactam activators are very useful herein, especially the acyl caprolactams (see for example WO 94-28102 A) and acyl valerolactams (see U.S. Pat. No. 5,503,639) of the formulae:

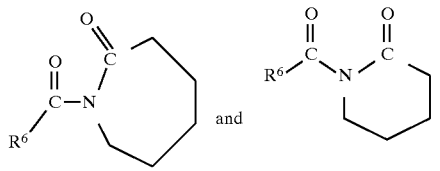

wherein $R^6$ is H, alkyl, aryl, alkoxyaryl, an alkaryl group containing from 1 to about 12 carbon atoms, or substituted phenyl containing from about 6 to about 18 carbons. See also U.S. Pat. No. 4,545,784 which discloses acyl caprolactams, including benzoyl caprolactam adsorbed into sodium perborate. In certain preferred embodiments of the detergent composition, NOBS, lactam activators, imide activators or amide-functional activators, especially the more hydrophobic derivatives, are desirably combined with hydrophilic activators such as TAED, typically at weight ratios of hydrophobic activator:TAED in the range of 1:5 to 5:1, preferably about 1:1. Other suitable lactam activators are alpha-modified, see WO 96-22350 A1, Jul. 25, 1996. Lactam activators, especially the more hydrophobic types, are desirably used in combination with TAED, typically at weight ratios of amido-derived or caprolactam activators : TAED in the range of 1:5 to 5:1, preferably about 1:1. See also the bleach activators having cyclic amidine leaving-group disclosed in U.S. Pat. No. 5,552,556.

Nonlimiting examples of additional activators useful herein are to be found in U.S. Pat. No. 4,915,854, U.S. Pat. No. 4,412,934 and 4,634,551. The hydrophobic activator nonanoyloxybenzene sulfonate (NOBS) and the hydrophilic tetraacetyl ethylene diamine (TAED) activator are typical, and mixtures thereof can also be used.

The superior bleaching/cleaning action of the detergent compositions is also preferably achieved with safety to natural rubber machine parts, for example of certain European washing appliances (see WO 94-28104) and other natural rubber articles, including fabrics containing natural rubber and natural rubber elastic materials. Complexities of bleaching mechanisms are legion and are not completely understood.

Additional activators useful herein include those of U.S. Pat. No. 5,545,349. Examples include esters of an organic acid and ethylene glycol, diethylene glycol or glycerin, or the acid imide of an organic acid and ethylenediamine, wherein the organic acid is selected from methoxyacetic acid, 2-methoxypropionic acid, p-methoxybenzoic acid, ethoxyacetic acid, 2-ethoxypropionic acid, p-ethoxybenzoic acid, propoxyacetic acid, 2-propoxypropionic acid, p-propoxybenzoic acid, butoxyacetic acid, 2-butoxypropionic acid, p-butoxybenzoic acid, 2-methoxyethoxyacetic acid,2-methoxy-1-methylethoxyacetic acid, 2-methoxy-2-methylethoxyacetic acid,2-ethoxyethoxyacetic acid, 2-(2-ethoxyethoxy) propionic acid, p-(2-ethoxyethoxy)benzoic acid, 2-ethoxy-l-methylethoxyacetic acid, 2-ethoxy-2-methylethoxyacetic acid, 2-propoxyethoxyacetic acid, 2-propoxy-1-methylethoxyaceticacid, 2-propoxy-2-methylethoxyacetic acid, 2-butoxyethoxyacetic acid,2-butoxy-1-methylethoxyacetic acid, 2-butoxy-2-methylethoxyacetic acid, 2-(2-methoxyethoxy)ethoxyacetic acid, 2-(2-methoxy-1-methylethoxy)ethoxyacetic acid, 2-(2-methoxy-2-methylethoxy)ethoxyacetic acid and 2-(2-ethoxyethoxy) ethoxyacetic acid.

(5) Bleach Catalysts

If desired, the bleaching compounds can be catalyzed by means of a manganese compound. Such compounds are well known in the art and include, for example, the manganese-based catalysts disclosed in U.S. Pat. No. 5,246,621, U.S. Pat. No. 5,244,594; U.S. Pat. No. 5,194,416; U.S. Pat. No. 5,114,606; and European Pat. App. Pub. Nos. 549,271A1, 549,272A1, 544,440A2, and 544,490A1; Preferred examples of these catalysts include $Mn^{IV}_2(u\text{-}O)_3(1,4,7\text{-trimethyl-}1,4,7\text{-triazacyclononane})_2(PF_6)_2$, $Mn^{III}_2(u\text{-}O)_1(u\text{-}OAc)_2(1,4,7\text{-trimethyl-}1,4,7\text{-triazacyclononane})_2\text{-}(ClO_4)_2$, $Mn^{IV}_4(u\text{-}O)_6(1,4,7\text{-triazacyclononane})_4(ClO_4)_4$, $Mn^{III}Mn^{IV}_4(u\text{-}O)_1(u\text{-}OAc)_2\text{-}(1,4,7\text{-trimethyl-}1,4,7\text{-triazacyclononane})_2(ClO_4)_3$, $Mn^{IV}(1,4,7\text{-trimethyl-}1,4,7\text{-triazacyclononane})\text{-}(OCH_3)_3(PF_6)$, and mixtures thereof. Other metal-based bleach catalysts include those disclosed in U.S. Pat. No. 4,430,243 and U.S. Pat. No. 5,114,611. The use of manganese with various complex ligands to enhance bleaching is also reported in the following U.S. Pat. Nos.: 4,728,455; 5,284,944; 5,246,612; 5,256,779; 5,280,117; 5,274,147; 5,153,161; and 5,227,084.

As a practical matter, and not by way of limitation, the compositions and processes herein can be adjusted to provide on the order of at least one part per ten million of the active bleach catalyst species in the aqueous washing liquor, and will preferably provide from about 0.1 ppm to about 700 ppm, more preferably from about 1 ppm to about 500 ppm, of the catalyst species in the laundry liquor.

(6) Bleach Reducing Agent

Any bleach reducing agent known in the art can be incorporated at levels typically from about 0.01% to about 10%, by weight, into the detergent compositions herein. Non limiting examples of bleach reducing agents include sulfurous acid or its salt (i.e., sulfite), hydrosulfite ($Na_2S_2O_4$ dihydrates), rongalite (mixture of hydrosulfite+formalin), and thioureadioxide.

5. Brightener

Any optical brighteners or other brightening or whitening agents known in the art can be incorporated at levels typically from about 0.05% to about 1.2%, by weight, into the detergent compositions herein. Commercial optical brighteners which may be useful in the detergent composition can be classified into subgroups, which include, but are not necessarily limited to, derivatives of stilbene, pyrazoline, coumarin, carboxylic acid, methinecyanines, dibenzothiphene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982).

6. Chelating Agents

The detergent compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined.

Amino carboxylates useful as optional chelating agents include ethylenediaminetetracetates, N-hydroxyethylethylenediaminetriacetates, nitrilotriacetates, ethylenediamine tetraproprionates, triethylenetetraaminehexacetates, diethylenetriaminepentaacetates, and ethanoldiglycines, alkali metal, ammonium, and substituted ammonium salts therein and mixtures therein.

Amino phosphonates are also suitable for use as chelating agents in the compositions when at least low levels of total phosphorus are permitted in detergent compositions, and include ethylenediaminetetrakis (methylenephosphonates) as DEQUEST.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxyd isulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

The compositions herein may also contain water-soluble methyl glycine diacetic acid (MGDA) salts (or acid form) as a chelant or co-builder useful with, for example, insoluble builders such as zeolites, layered silicates and the like.

If utilized, these chelating agents will generally comprise from about 0.1% to about 15% by weight of the detergent compositions herein.

7. Clay Soil Removal/Anti-redeposition Agents

The detergent compositions can also optionally contain water-soluble ethoxylated amines having clay soil removal and antiredeposition properties. Granular detergent compositions which contain these compounds typically contain from about 0.01% to about 10.0% by weight of the water-soluble ethoxylates amines; liquid detergent compositions typically contain about 0.01% to about 5%.

The most preferred soil release and anti-redeposition agent is ethoxylated tetraethylenepentamine. Exemplary ethoxylated amines are further described in U.S. Pat. No. 4,597,898 to VanderMeer, issued Jul. 1, 1986. Another group of preferred clay soil removal-antiredeposition agents are the cationic compounds disclosed in European Patent Application 111,965, Oh and Gosselink, published Jun. 27, 1984. Other clay soil removal/antiredeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other clay soil removal and/or anti redeposition agents known in the art can also be utilized in the compositions herein. Another type of preferred antiredeposition agent includes the carboxy methyl cellulose (CMC) materials. These materials are well known in the art.

8. Dye Transfer Inhibiting Agents

The detergent compositions may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

The most preferred polyamine N-oxide useful as dye transfer inhibiting polymers in the detergent compositions herein is poly(4-vinylpyridine-N-oxide) which as an average molecular weight of about 50,000 and an amine to amine N-oxide ratio of about 1:4.

Copolymers of N-vinylpyrrolidone and N-vinylimidazole polymers (referred to as a class as "PVPVI") are also suitable for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis*, Vol 113. "Modern Methods of Polymer Characterization".) The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The detergent composition also may employ as a dye transfer inhibitor a polyvinylpyrrolidone ("PVP") having an average molecular weight of from about 5,000 to about 400,000, preferably from about 5,000 to about 200,000, and more preferably from about 5,000 to about 50,000. PVP's are known to persons skilled in the detergent field; see, for example, EP-A-262,897 and EP-A-256,696. Compositions containing PVP dye transfer inhibitors can also contain polyethylene glycol ("PEG") having an average molecular weight from about 500 to about 100,000, preferably from about 1,000 to about 10,000. Preferably, the ratio of PEG to PVP on a ppm basis delivered in wash solutions is from about 2:1 to about 50:1, and more preferably from about 3:1 to about 10:1.

9. Enzymes

Enzymes can be included in the detergent compositions for a variety of purposes, including removal of protein-based, carbohydrate-based, or triglyceride-based stains from substrates, for the prevention of refugee dye transfer in fabric laundering, and for fabric restoration. Suitable enzymes include proteases, amylases, lipases, cellulases, peroxidases, and mixtures thereof of any suitable origin, such as vegetable, animal, bacterial, fungal and yeast origin. Preferred selections are influenced by factors such as pH-activity and/or stability optima, thermostability, and stability to active detergents, builders and the like. In this respect bacterial or fungal enzymes are preferred, such as bacterial amylases and proteases, and fungal cellulases.

"Detersive enzyme", as used herein, means any enzyme having a cleaning, stain removing or otherwise beneficial effect in a laundry, hard surface cleaning or personal care detergent composition. Preferred detersive enzymes are hydrolases such as proteases, amylases and lipases. Preferred enzymes for laundry purposes include, but are not limited to, proteases, cellulases, lipases and peroxidases. Highly preferred for automatic dishwashing are amylases and/or proteases, including both current commercially available types and improved types which, though more and more bleach compatible though successive improvements, have a remaining degree of bleach deactivation susceptibility.

Enzymes are normally incorporated into detergent or detergent additive compositions at levels sufficient to provide a "cleaning-effective amount". The term "cleaning effective amount" refers to any amount capable of producing a cleaning, stain removal, soil removal, whitening, deodorizing, or freshness improving effect on substrates such as fabrics, dishware and the like. In practical terms for current commercial preparations, typical amounts are up to about 5 mg by weight, more typically 0.01 mg to 3 mg, of active enzyme per gram of the detergent composition. Stated otherwise, the compositions herein will typically comprise from 0.001% to 5%, preferably 0.01%–1% by weight of a commercial enzyme preparation. Protease enzymes are usually present in such commercial preparations at levels sufficient to provide from 0.005 to 0.1 Anson units (AU) of activity per gram of composition. For certain detergents, such as in automatic dishwashing, it may be desirable to increase the active enzyme content of the commercial preparation in order to minimize the total amount of non-catalytically active materials and thereby improve spotting/filming or other end-results. Higher active levels may also be desirable in highly concentrated detergent formulations.

10. Enzyme Stabilizing System

Enzyme-containing, including but not limited to, liquid compositions, herein may comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the detersive enzyme. Such a system may be inherently provided by other formulation actives, or be added separately, e.g., by the formulator or by a manufacturer of detergent-ready enzymes. Such stabilizing systems can, for example, comprise calcium ion, boric acid, propylene glycol, short chain carboxylic acids, boronic acids, and mixtures thereof, and are designed to address different stabilization problems depending on the type and physical form of the detergent composition.

11. Fabric Softeners

Various through-the-wash fabric softeners, especially the impalpable smectite clays of U.S. Pat. No. 4,062,647, Storm and Nirschl, issued Dec. 13, 1977, as well as other softener clays known in the art, can optionally be used typically at levels of from about 0.5% to about 10% by weight in the detergent compositions to provide fabric softener benefits concurrently with fabric cleaning. Clay softeners can be used in combination with amine and cationic softeners as disclosed, for example, in U.S. Pat. No. 4,375,416, Crisp et al, Mar. 1, 1983 and U.S. Pat. No. 4,291,071, Harris et al, issued Sep. 22, 1981.

12. Polymeric Soil Release Agent

Known polymeric soil release agents, hereinafter "SRA", can optionally be employed in the present detergent compositions. If utilized, SRA's will generally comprise from 0.01% to 10.0%, typically from 0.1% to 5%, preferably from 0.2% to 3.0% by weight, of the compositions.

Preferred SRA's include oligomeric terephthalate esters.

Suitable SRA's also include a sulfonated product of a substantially linear ester oligomer comprised of an oligomeric ester backbone of terephthaloyl and oxyalkyleneoxy repeat units and allyl-derived sulfonated terminal moieties covalently attached to the backbone, for example as described in U.S. Pat. No. 4,968,451, Nov. 6, 1990 to J. J. Scheibel and E. P. Gosselink. Other SRA's include the nonionic end-capped 1,2-propylene/polyoxyethylene terephthalate polyesters of U.S. Pat. No. 4,711,730, Dec. 8, 1987 to Gosselink et al., for example those produced by transesterification/oligomerization of poly(ethyleneglycol) methyl ether, DMT, PG and poly(ethyleneglycol) ("PEG"). Other examples of SRA's include: the partly- and fully-anionic-end-capped oligomeric esters of U.S. Pat. No. 4,721,580, Jan. 26, 1988 to Gosselink, such as oligomers from ethylene glycol ("EG"), PG, DMT and Na-3,6-dioxa-8-hydroxyoctanesulfonate; the nonionic-capped block polyester oligomeric compounds of U.S. Pat. No. 4,702,857, Oct. 27, 1987 to Gosselink, for example produced from DMT, methyl (Me)-capped PEG and EG and/or PG, or a combination of DMT, EG and/or PG, Me-capped PEG and Na-dimethyl-5-sulfoisophthalate; and the anionic, especially sulfoaroyl, end-capped terephthalate esters of U.S. Pat. No. 4,877,896, Oct. 31, 1989 to Maldonado, Gosselink et al., the latter being typical of SRA's useful in both laundry and fabric conditioning products, an example being an ester composition made from m-sulfobenzoic acid monosodium salt, PG and DMT, optionally but preferably further comprising added PEG, e.g., PEG 3400.

SRA's also include: simple copolymeric blocks of ethylene terephthalate or propylene terephthalate with polyethylene oxide or polypropylene oxide terephthalate, see U.S. Pat. No. 3,959,230 to Hays, May 25, 1976 and U.S. Pat. No. 3,893,929 to Basadur, Jul. 8, 1975; cellulosic derivatives such as the hydroxyether cellulosic polymers available as METHOCEL from Dow; the $C_1$–$C_4$ alkyl celluloses and $C_4$ hydroxyalkyl celluloses, see U.S. Pat. No. 4,000,093, Dec. 28, 1976 to Nicol, et al.; and the methyl cellulose ethers having an average degree of substitution (methyl) per anhydroglucose unit from about 1.6 to about 2.3 and a solution viscosity of from about 80 to about 120 centipoise measured at 20° C. as a 2% aqueous solution. Such materials are available as METOLOSE SM100 and METOLOSE SM200, which are the trade names of methyl cellulose ethers manufactured by Shin-etsu Kagaku Kogyo KK.

Suitable SRA's characterized by poly(vinyl ester) hydrophobe segments include graft copolymers of poly(vinyl ester), e.g., $C_1$–$C_6$ vinyl esters, preferably poly(vinyl acetate), grafted onto polyalkylene oxide backbones. See European Patent Application 0 219 048, published Apr. 22, 1987 by Kud, et al. Commercially available examples include SOKALAN SRA's such as SOKALAN HP-22, available from BASF, Germany. Other SRA's are polyesters with repeat units containing 10–15% by weight of ethylene terephthalate together with 80–90% by weight of polyoxyethylene terephthalate derived from a polyoxyethylene glycol of average molecular weight 300–5,000. Commercial examples include ZELCON 5126 from DuPont and MILEASE T from ICI.

Another preferred SRA is an oligomer having empirical formula $(CAP)_2(EG/PG)_5(T)_5(SIP)_1$ which comprises terephthaloyl (T), sulfoisophthaloyl (SIP), oxyethyleneoxy and oxy-1,2-propylene (EG/PG) units and which is preferably terminated with end-caps (CAP), preferably modified isethionates, as in an oligomer comprising one sulfoisophthaloyl unit, 5 terephthaloyl units, oxyethyleneoxy and oxy-1,2-propyleneoxy units in a defined ratio, preferably about 0.5:1 to about 10:1, and two end-cap units derived from sodium 2-(2-hydroxyethoxy)-ethanesulfonate.

Yet another group of preferred SRA's are oligomeric esters comprising: (1) a backbone comprising (a) at least one unit selected from the group consisting of dihydroxysulfonates, polyhydroxy sulfonates, a unit which is at least trifunctional whereby ester linkages are formed resulting in a branched oligomer backbone, and combinations thereof; (b) at least one unit which is a terephthaloyl moiety; and (c) at least one unsulfonated unit which is a 1,2-oxyalkyleneoxy moiety; and (2) one or more capping units selected from nonionic capping units, anionic capping units such as alkoxylated, preferably ethoxylated, isethionates, alkoxylated propanesulfonates, alkoxylated propanedisulfonates, alkoxylated phenolsulfonates, sulfoaroyl derivatives and mixtures thereof.

Additional classes of SRA's include: (I) nonionic terephthalates using diisocyanate coupling agents to link polymeric ester structures, see U.S. Pat, No. 4,201,824, Violland et al. and U.S. Pat. No. 4,240,918 to Lagasse et al.; and (II) SRA's with carboxylate terminal groups made by adding trimellitic anhydride to known SRA's to convert terminal hydroxyl groups to trimellitate esters. Other classes include: (III) anionic terephthalate-based SRA's of the urethane-linked variety, see U.S. Pat. No. 4,201,824, Violland et al.; (IV) poly(vinyl caprolactam) and related co-polymers with monomers such as vinyl pyrrolidone and/or dimethylaminoethyl methacrylate, including both nonionic and cationic polymers, see U.S. Pat. No. 4,579,681, Ruppert et al.; (V) graft copolymers, in addition to the SOKALAN types from BASF, made by grafting acrylic monomers onto sulfonated polyesters. Still other classes include: (VI) grafts of vinyl monomers such as acrylic acid and vinyl acetate onto proteins such as caseins, see EP 457,205 A to BASF (1991); and (VII) polyester-polyamide SRA's prepared by condensing adipic acid, caprolactam, and polyethylene glycol, especially for treating polyamide fabrics, see Bevan et al., DE 2,335,044 to Unilever N. V., 1974. Other useful SRA's are described in U.S. Pat. Nos. 4,240,918, 4,787,989 and 4,525,524.

The detergent composition can optionally contain a polyamine soil release agent related to modified polyamines. See U.S. Pat. No. 5,565,145 issued Oct. 15, 1996 to Watson et al.

The preferred polyamine soil release agents that comprise the backbone of the compounds are generally polyalkyleneamines (PAA's), polyalkyleneimines (PAI's), preferably polyethyleneamine (PEA's), polyethyleneimines (PEI's), or PEA's or PEI's connected by moieties having longer R units than the parent PAA's, PAI's, PEA's or PEI's. A common polyalkyleneamine (PAA) is tetrabutylenepentamine. The common PEA's obtained are triethylenetetramine (TETA) and teraethylenepentamine (TEPA). Above the pentamines, i.e., the hexamines, heptamines, octamines and possibly nonamines, the cogenerically derived mixture does not appear to separate by distillation and can include other materials such as cyclic amines and particularly piperazines. There can also be present cyclic amines with side chains in which nitrogen atoms appear. See U.S. Pat. No. 2,792,372 to Dickinson, issued May 14, 1957, which describes the preparation of PEA's.

The polyamine soil release agents if included in the detergent composition, is included from about 0.01% to about 5%; preferably about 0.3% to about 4%; more preferably about 0.5% to about 2.5%, by weight of the detergent composition.

13. Polymeric Dispersing Agent

Polymeric dispersing agents can advantageously be utilized at levels from about 0.1% to about 7%, by weight, in the compositions herein, especially in the presence of zeolite and/or layered silicate builders. Suitable polymeric dispersing agents include polymeric polycarboxylates and polyethylene glycols, although others known in the art can also be used.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1.

Another polymeric material which can be included is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite builders. Dispersing agents such as polyaspartate preferably have a molecular weight (avg.) of about 10,000.

14. Suds Suppressors

Compounds for reducing or suppressing the formation of suds can be incorporated into the detergent compositions. Suds suppression can be of particular importance in the so-called "high concentration cleaning process" as described in U.S. Pat. Nos. 4,489,455 and 4,489,574 and in front-loading European-style washing machines.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acid and soluble salts therein. See U.S. Pat. No. 2,954,347, issued Sep. 27, 1960 to Wayne St. John. The monocarboxylic fatty acids and salts thereof used as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

The detergent compositions herein may also contain non-surfactant suds suppressors. These include, for example: high molecular weight hydrocarbons such as paraffin, fatty acid esters (e.g., fatty acid triglycerides), fatty acid esters of monovalent alcohols, aliphatic $C_{18}$–$C_{40}$ ketones (e.g., stearone), etc. Other suds inhibitors include N-alkylated amino triazines such as tri- to hexa-alkylmelamines or di- to tetra-alkyldiamine chlortriazines formed as products of cyanuric chloride with two or three moles of a primary or secondary amine containing 1 to 24 carbon atoms, propylene oxide, and monostearyl phosphates such as monostearyl alcohol phosphate ester and monostearyl di-alkali metal (e.g., K, Na, and Li) phosphates and phosphate esters.

Another preferred category of non-surfactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica.

Mixtures of silicone and silanated silica are described, for instance, in German Patent Application DOS 2,124,526. Silicone defoamers and suds controlling agents in granular detergent compositions are disclosed in U.S. Pat. No. 3,933,672, Bartolotta et al, and in U.S. Pat. No. 4,652,392, Baginski et al, issued Mar. 24, 1987.

The silicone suds suppressor herein preferably comprises polyethylene glycol and a copolymer of polyethylene glycol/polypropylene glycol, all having an average molecular weight of less than about 1,000, preferably between about 100 and 800. The polyethylene glycol and polyethylene/polypropylene copolymers herein have a solubility in water at room temperature of more than about 2 weight %, preferably more than about 5 weight %.

Other suds suppressors useful herein comprise the secondary alcohols (e.g., 2-alkyl alkanols) and mixtures of such alcohols with silicone oils, such as the silicones disclosed in U.S. Pat. Nos. 4,798,679, 4,075,118 and EP 150,872. The secondary alcohols include the $C_6$–$C_{16}$ alkyl alcohols having a $C_1$–$C_{16}$ chain.

For any detergent compositions to be used in automatic laundry washing machines, suds should not form to the extent that they overflow the washing machine. Suds suppressors, when utilized, are preferably present in a "suds suppressing amount. By "suds suppressing amount" is meant that the formulator of the composition can select an amount of this suds controlling agent that will sufficiently control the suds to result in a low-sudsing laundry detergent for use in automatic laundry washing machines.

The compositions herein will generally comprise from 0% to about 5% of suds suppressor.

15. Other Ingredients

A wide variety of other ingredients useful in detergent compositions can be included in the compositions herein, including other active ingredients, carriers, hydrotropes, processing aids, dyes or pigments, solvents for liquid formulations, solid fillers for bar compositions, etc. If high sudsing is desired, suds boosters such as the $C_{10}$–$C_{16}$ alkanolamides can be incorporated into the compositions, typically at 1%–10% levels. The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous. If desired, soluble magnesium salts such as $MgCl_2$, $MgSO_4$, and the like, can be added at levels of, typically, 0.1%–2%, to provide additional suds and to enhance grease removal performance.

Liquid detergent compositions can contain water and other detergent solvents as carriers. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., 1,3-propanediol, ethylene glycol, glycerine, and 1,2-propanediol) can also be used. The compositions may contain from 5% to 90%, typically 10% to 50% of such carriers.

The detergent compositions herein will preferably be formulated such that, during use in aqueous cleaning operations, the wash water will have a pH of between about 6.5 and about 11, preferably between about 7.5 and 10.5. Liquid dishwashing product formulations preferably have a pH between about 6.8 and about 9.0. Laundry products are typically at pH 9–11. Techniques for controlling pH at recommended usage levels include the use of buffers, alkalis, acids, etc., and are well known to those skilled in the art.

Preferred detergent compositions for use in the present invention are described in detail below. In the detergent compositions, the enzymes levels are expressed by pure enzyme by weight of the total composition and unless otherwise specified, the detergent ingredients are expressed by weight of the total compositions. The abbreviated component identifications therein have the following meanings:

LAS: Sodium linear $C_{11-3}$ alkyl benzene sulphonate.

CxyAS: Sodium $C_{1x}$–$C_{1y}$ alkyl sulfate.

CxyEz: $C_{1x}$–$C_{1y}$ predominantly linear primary alcohol condensed with an average of z moles of ethylene oxide.

CxyEzS: $C_{1x}$–$C_{1y}$ sodium alkyl sulfate condensed with an average of z moles of ethylene oxide.

Nonionic: $C_{13}$–$C_{15}$ mixed ethoxylated/propoxylated fatty alcohol with an average degree of ethoxylation of 3.8 and an average degree of propoxylation of 4.5.

TPKFA: $C_{12}$–$C_{14}$ topped whole cut fatty acids.

SDASA: 1:2 ratio of stearyldimethyl amine:triple-pressed stearic acid.

Silicate: Amorphous Sodium Silicate ($SiO_2$:$Na_2O$ ratio= 1.6–3.2).

Zeolite A: Hydrated Sodium Aluminosilicate of formula $Na_{12}(A1O_2SiO_2)_{12}$. $27H_2O$ having a primary particle size in the range from 0.1 to 10 micrometers (Weight expressed on an anhydrous basis).

Na-SKS-6: Crystalline layered silicate of formula $\delta$-$Na_2Si_2O_5$.

Citrate: Tri-sodium citrate dihydrate of activity 86.4% with a particle size distribution between 425 and 850 micrometers.

Citric: Anhydrous citric acid.

Borate: Sodium borate

Carbonate: Anhydrous sodium carbonate with a particle size between 200 and 900 micrometers.

Bicarbonate: Anhydrous sodium hydrogen carbonate with a particle size distribution between 400 and 1200 micrometers.

Sulphate: Anhydrous sodium sulphate.

STPP: Sodium tripolyphosphate.

TSPP: Tetrasodium pyrophosphate.

MA/AA: Random copolymer of 4:1 acrylate/maleate, average molecular weight about 70,000–80,000.

PB1: Anhydrous sodium perborate monohydrate of nominal formula $NaBO_2.H_2O_2$.

TAED: Tetraacetylethylenediamine.

NOBS: Nonanoyloxybenzene sulfonate in the form of the sodium salt.

DTPA: Diethylene triamine pentaacetic acid.

HEDP: 1,1-hydroxyethane diphosphonic acid.

DETPMP: Diethyltriamine penta (methylene) phosphonate, marketed by Monsanto under the Trade name Dequest 2060.

Protease: Proteolytic enzyme sold under the tradename Savinase, Alcalase, Durazym by Novo Nordisk A/S, Maxacal, Maxapem sold by Gist-Brocades and proteases described in patents WO91/06637 and/or WO95/10591 and/or EP 251 446.

Amylase: Amylolytic enzyme sold under the tradename Purafact Ox $Am^R$ described in WO 94/18314, WO96/05295 sold by Genencor; Termamyl®, Fungamyl® and Duramyl®, all available from Novo Nordisk A/S and those described in WO95/26397.

Lipase: Lipolytic enzyme sold under the tradename Lipolase, Lipolase Ultra by Novo Nordisk A/S and Lipomax by Gist-Brocades.

Cellulase: Cellulytic enzyme sold under the tradename Carezyme, Celluzyme and/or Endolase by Novo Nordisk A/S.

Brightener 1: Disodium 4,4'-bis(2-sulphostyryl)biphenyl.

Brightener 2: Disodium 4,4'-bis(4-anilino-6-morpholino-1.3.5-triazin-2-yl) stilbene-2:2'-disulfonate.

Silicone antifoam: Polydimethylsiloxane foam controller with siloxane-oxyalkylene copolymer as dispersing agent with a ratio of said foam controller to said dispersing agent of 10:1 to 100:1.

Suds Suppressor: 12% Silicone/silica, 18% stearyl alcohol, 70% starch in granular form.

Opacifier: Water based monostyrene latex mixture, sold by BASF Aktiengesellschaft under the tradename Lytron 621.

SRP 1: Anionically end capped poly esters.

SRP 2: Diethoxylated poly (1,2 propylene terephtalate) short block polymer.

SCS: Sodium cumene sulphonate.

PEGx: Polyethylene glycol, of a molecular weight of x.

TEPAE: Tetreaethylenepentaamine ethoxylate.

pH: Measured as a 1% solution in distilled water at 20° C.

EXAMPLE 9

The following high density granular laundry detergent compositions can be used in the present invention:

| | I | II |
|---|---|---|
| LAS | 24.0 | 21.0 |
| AS | 5.0 | 3.0 |
| C25A9 | 4.0 | 3.0 |
| Coco Methyl EO4 | 0.5 | 1.0 |
| MA/AA | 7.0 | 15.0 |
| NaSKS-6 | 8.0 | 5.0 |
| Zeolite A | 13.0 | 11.0 |
| Na2CO3 | 15.0 | 12.0 |
| Protease I | 0.2 | 0.5 |
| Cellulase | 0.5 | 0.5 |
| Amylase | — | 0.6 |
| Lipase | — | 0.3 |
| NOBS | 3.0 | 4.0 |
| PB1 | 4.0 | 3.0 |
| Brightener 2 | 0.1 | 0.1 |
| Brightener 1 | 0.2 | 0.2 |
| SRP 1 | 0.3 | 0.3 |
| SRP 2 | 0.4 | 0.4 |
| Misc. & Minors | Balance | Balance |
| | 100 | 100 |

EXAMPLE 10

The following liquid detergent composition can be used in the present invention (Levels are given in parts per weight, enzyme are expressed in pure enzyme):

| | |
|---|---|
| LAS | 11.5 |
| C45E2.25S | 11.5 |
| C23E7 | 3.2 |
| TPKFA | 1.6 |
| Citric (50%) | 6.5 |
| Ca formate | 0.1 |
| Na formate | 0.5 |
| SCS | 4.0 |
| Borate | 0.6 |
| Na hydroxide | 5.8 |
| Ethanol | 1.75 |
| 1,2 Propanediol | 3.3 |
| Monoethanolamine | 3.0 |
| TEPAE | 1.6 |
| Protease | 0.03 |
| SRP 1 | 0.2 |
| Brightener 1 | 0.2 |
| Silicone antifoam | 0.04 |
| Miscellaneous and water | Balance |
| | 100 |

EXAMPLE 11

The following liquid detergent composition can be used in the present invention (Levels are given in parts per weight, enzyme are expressed in pure enzyme):

| | |
|---|---|
| LAS | 10.0 |
| C25AS | 4.0 |
| C25E3S | 1.0 |
| C25E7 | 6.0 |
| TPKFA | 2.0 |
| Citric | 2.0 |
| Dodecenyl/tetradecenyl succinic acid | 12.0 |
| Rapeseed fatty acid | 4.0 |
| Ethanol | 4.0 |
| 1,2 Propanediol | 4.0 |
| TEPAE | 0.5 |
| DETPMP | 1.0 |
| Protease | 0.02 |
| Amylase | 0.004 |
| SRP 2 | 0.3 |
| Boric acid | 0.1 |
| Suds suppresor | 0.1 |
| Opacifier | 0.5 |
| NaOH up to pH | 8.0 |
| Miscellaneous and water | Balance |
| | 100 |

EXAMPLE 12

The following liquid detergent compositions can be used in the present invention (Levels are given in parts by weight, enzyme are expressed in pure enzyme):

| | I | II |
|---|---|---|
| LAS | 27.6 | 18.9 |
| C45AS | 13.8 | 5.9 |
| C13E8 | 3.0 | 3.1 |
| Oleic acid | 3.4 | 2.5 |
| Citric | 5.4 | 5.4 |
| Na hydroxide | 0.4 | 3.6 |
| Ca Formate | 0.2 | 0.1 |
| Na Formate | — | 0.5 |
| Ethanol | 7.0 | — |
| Monoethanolamine | 16.5 | 8.0 |
| 1,2 propanediol | 5.9 | 5.5 |
| Xylene sulfonic acid | — | 2.4 |
| TEPAE | 1.5 | 0.8 |
| Protease | 0.05 | 0.02 |
| Carbohydrase | | |
| PEG | — | 0.7 |
| Brightener 2 | 0.4 | 0.1 |
| Perfume | 0.5 | 0.3 |
| Waters and Minors | Balance | Balance |
| | 100 | 100 |

EXAMPLE 13

The following nil-bleach containing detergent compositions of particular use in the washing of colored clothing can be used in the present invention:

| | | I | II | III |
|---|---|---|---|---|
| Blown Powder | Zeolite A | 15.0 | 15.0 | — |
| | Sulfate | — | 5.0 | — |
| | LAS | 3.0 | 3.0 | — |
| | DETPMP | 0.4 | 0.5 | — |

-continued

| | | I | II | III |
|---|---|---|---|---|
| | CMC | 0.4 | 0.4 | — |
| | MA/AA | 4.0 | 4.0 | — |
| Agglomerates | C45AS | — | — | 11.0 |
| | LAS | 6.0 | 5.0 | — |
| | TAS | 3.0 | 2.0 | — |
| | Silicate | 4.0 | 4.0 | — |
| | Zeolite A | 10.0 | 15.0 | 13.0 |
| | CMC | — | — | 0.5 |
| | MA/AA | — | — | 2.0 |
| | Carbonate | 9.0 | 7.0 | 7.0 |
| Spray-on | Perfume | 0.3 | 0.3 | 0.5 |
| | C45E7 | 4.0 | 4.0 | 4.0 |
| | C25E3 | 2.0 | 2.0 | 2.0 |
| Dry additives | MA/AA | — | — | 3.0 |
| | Na-SKS-6 | — | — | 12.0 |
| | Citrate | 10.0 | — | 8.0 |
| | Bicarbonate | 7.0 | 3.0 | 5.0 |
| | Carbonate | 8.0 | 5.0 | 7.0 |
| | PVPVI/PVNO | 0.5 | 0.5 | 0.5 |
| | Protease | 0.03 | 0.02 | 0.05 |
| | Lipase | 0.008 | 0.008 | 0.008 |
| | Amylase | 0.01 | 0.01 | 0.01 |
| | Cellulase | 0.001 | 0.001 | 0.001 |
| | Silicone antifoam | 5.0 | 5.0 | 5.0 |
| | Sulfate | — | 9.0 | — |
| Density (g/liter) | | 700 | 700 | 700 |
| Miscellaneous and minors | | | Up to 100% | |

EXAMPLE 14

The following detergent additive compositions can be used in the present invention:

| | I | II | III |
|---|---|---|---|
| LAS | — | 50 | 5.0 |
| STPP | 30.0 | — | 20.0 |
| Zeolite A | — | 35.0 | 20.0 |
| PB1 | 20.0 | 15.0 | — |
| TAED | 10.0 | 8.0 | — |
| Protease | — | 0.3 | 0.3 |
| Amylase | — | 0.06 | 0.06 |
| Minors, water and miscellaneous | | Balance | |
| | | 100 | |

EXAMPLE 15

The following liquid hard surface cleaning compositions can be used in the present invention:

| | I | II | III |
|---|---|---|---|
| Amylase | 0.01 | 0.002 | 0.005 |
| Protease | 0.05 | 0.01 | 0.02 |
| EDTA* | 0.05 | 0.05 | 0.05 |
| Citrate | 2.9 | 2.9 | 2.9 |
| LAS | 0.5 | 0.5 | 0.5 |
| C12 AS | 0.5 | 0.5 | 0.5 |
| C12(E)S | 0.5 | 0.5 | 0.5 |
| C12, 13 E6.5 nonionic | 7.0 | 7.0 | 7.0 |
| Perfume | 1.0 | 1.0 | 1.0 |
| Hexyl carbitol** | 1.0 | 1.0 | 1.0 |

-continued

| | I | II | III |
|---|---|---|---|
| SCS | 1.3 | 1.3 | 1.3 |
| Water | | Balance | |
| | | 100 | |

*Na4 ethylenediamine diacetic acid
**Diethylene glycol monohexyl ether
***All formulas adjusted to pH 7–12

EXAMPLE 16

The following non-aqueous liquid detergent composition with bleach can be used in the present invention.

| Component | Wt % Active |
|---|---|
| LAS Powder | 20.26 |
| C12–14 E5 | 18.82 |
| Butoxy Propoxy Propanol | 18.82 |
| Sodium citrate dihydrate | 4.32 |
| Citrate Coated NOBS | 8.49 |
| Sodium Carbonate | 11.58 |
| MA/AA | 11.58 |
| DTPA | 0.77 |
| Protease Prills | 0.77 |
| Amylase Prills | 0.39 |
| PB1 | 2.86 |
| Suds Suppressor | 0.03 |
| Perfume | 0.46 |
| Titanium Dioxide | 0.54 |
| Brightener 1 | 0.31 |
| | 100.00% |

EXAMPLE 17

The following tablet composition can be used in the present invention.

| | % by weight |
|---|---|
| Anionic agglomerates[1] | 26.80 |
| Nonionic agglomerates[2] | 5.93 |
| Bleach activator agglomerates[3] | 6.10 |
| Zinc Phthalocyanine sulphonate encapsulate[4] | 0.03 |
| Suds suppressor[5] | 3.46 |
| Dried Zeolite | 6.75 |
| Layered Silicate[6] | 14.67 |
| Dye transfer inhibitor agglomerate[7] | 0.14 |
| Perfume encapsulates[8] | 0.25 |
| Nonionic paste spray-on[9] | 5.82 |
| Brightener 1 | 0.28 |
| Sodium carbonate | 5.02 |
| PB 1 | 21.20 |
| Sodium HEDP | 0.85 |
| SRP2 | 0.19 |
| Perfume | 0.35 |
| Protease | 0.92 |
| Cellulase | 0.27 |
| Lipase | 0.23 |
| Amylase | 0.75 |
| Citric | 2.28 |
| Bicarbonate | 2.73 |

-continued

| | % by weight |
|---|---|
| Sodium acetate | 15.00 |
| Minors | Balance |
| | 100 |

[1]Anionic agglomerates comprise 38% anionic surfactant, 22% zeolite and 40% carbonate.
[2]Nonionic agglomerates comprise 26% nonionic surfactant, 48% zeolite and 26% carbonate.
[3]Bleach activator agglomerates comprise 81% TAED, 17% acrylic/maleic copolymer (acid form) and 2% water.
[4]Zinc phthalocyanine sulphonate encapsulates are 10% active.
[5]Suds suppressor comprises 11.5% silicone oil (ex. Dow Corning) and 88.5% starch.
[6]Layered silicate comprises 78% SKS-6 (ex Hoechst) and 22% citric acid
[7]Dye transfer inhibitor agglomerates comprise 21% PVNO/PVPVI, 61% zeolite and 18% carbonate.
[8]Perfume encapsulates comprise 50% perfume and 50% starch.
[9]Nonionic paste spray-on comprises 67% C12–C15 AE5 (alcohol with average of 5 ethoxy groups per molecule), 24% N-methyl glucose amide and 9% water.

D. Solvent

The concentrated detergent solution made of the detergent composition as detailed in the above description is mixed with a solvent. The temperature of the solvent is not critical to the present invention.

One preferred solvent is water. The water can be from any available source, such as tap water from the faucet. If the solvent is water, the temperature at the time of use in the method of the present invention is preferably from about 5° C. to about 60° C., most preferably from about 10° C. to about 50° C. In one alternative embodiment of the invention wherein the detergent composition does not contain any bleach or enzymes, very hot, or boiling water (about 60° C.–100° C.) can be used to quickly dissolve the detergent composition in the hand-held container, with little or no agitation.

Other solvents besides water can also be used to make the concentrated detergent solution of the present invention. Organic solvents are preferred. A suitable organic solvent for this invention is an organic solvent which has a flash point of 10° C. and above. Non limiting examples of solvents include alcohols such as ethanol, propanol, glycerol, polyethylene glycol, propanediol, dipropylene glycol n-butyl ether, or any compound such as benzene sulfonic acid or its salt, toluene sulfonic acid or its salt, or xylene sulfonic acid or its salt. Mixtures of solvents can also be used to make the concentrated detergent solution of the present invention.

E. Agitation

In the method of the present invention, the contents of the hand-held container are preferably agitated after the addition of the detergent composition and the solvent. This step is preferred, but not required. Although not intending to be limited by theory, agitation accelerates the dissolving process of the detergent composition in the solvent. In addition, it is believed that for bleach-containing compositions which liberate peracids, the agitation helps accelerate the liberation of peracids in the solution to provide better bleaching performance.

In one preferred example of an agitation step, the user of the container shakes the secured container, containing the concentrated detergent solution. It is not critical to the method of the present invention as to how the container is shaken. For example, the user shakes the container in an up-and-down motion by holding the container in one hand and then shaking the container in an up-and-down vertical motion. The user can shake the container many times, but it is sufficient to shake it vertically for about 20 times before use of the solution in laundering fabrics. One vertical shake is defined as one up plus one down vertical motion. The preferred shaking speed is about 2 shakes per second. Another example of manual agitation is stirring the contents in the container with a rod or other apparatus.

Besides manual agitation, mechanical means can be used to agitate the concentrated detergent solution in the container. For example, a mechanical mixer having rotating blades can be used to agitate the contents. The mechanical agitator can optionally be a physical part of the container or can be a separate apparatus.

F. Indicator

In one preferred embodiment, the method of the present invention provides an indicator which indicates when the detergent composition in the solvent is sufficiently dissolved. Thus, the user will be able to tell when it is the best time to introduce the concentrated detergent solution to the fabric. There are many indicators that can signal to the user when the detergent composition in the solvent is sufficiently dissolved.

In one embodiment, the concentrated detergent solution changes its appearance which indicates to the user when the concentrated detergent solution is ready for use. When an appearance indicator is being used, it is preferred to have a sufficiently transparent or opaque hand-held container so that the user can see the appearance change.

In one embodiment, the solution changes from one color to another (or clear) upon a change of pH of the concentrated detergent solution. This color change will indicate to the user when the solution is ready for use.

In another embodiment for a reducing bleach-containing composition, the detergent composition comprises a dye that becomes nearly colorless when the dye decomposes via a chemical reaction of the dye with a reducing bleach.

In yet another preferred embodiment, an indicator system is used in a detergent composition in order to signal the minimum predissolving time of the concentrated detergent solution. The indicator system includes a dye particle and a bleach particle, wherein the bleach particle has at least one first binder coating, wherein the dye particle initially colors the solvent and upon dissolution of the binder coating, the solvent subsequently decolorizes by oxidation. The binder coating on the bleach delays the initiation of the oxidation process, thus controlling the length of time it takes to decolorize the dye particle. Examples of useful dye and binder material are described below. It is preferred that the decolorization takes place after about 10 seconds.

In one preferred embodiment for a bleach-containing composition, the detergent composition comprises a dye that becomes nearly colorless when oxidized in an aqueous solution containing a peroxide bleach. Preferably, such dyes are selected from a triphenylmethane- or diphenylmethane-based dye having the following partial structure:

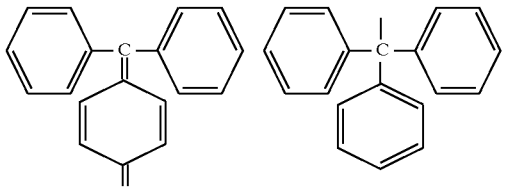

-continued

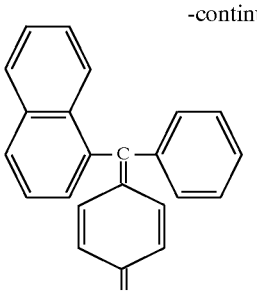

Specific examples of such dyes include C.I. Acid Green 9, C.I. Acid Violet 49, and C.I. Acid Blue 7. These dyes are added in an amount of 0.01 to 2000 ppm to the bleach composition and detergent bleach composition, with 20 to 1000 ppm being particularly favorable. The dye is added in a form in which it has been stabilized by being granulated separately from the peroxide. Examples of granulation methods include a dry granulation method in which polyethylene glycol is used as a binder, and a wet granulation method in which carboxymethyl cellulose or the like is used as a binder. The amount in which the dye is added to the granulation product is 1 to 100,000 ppm, with 100 to 5000 ppm being preferable. See JP Laid Open application No. 5-25493, published on Feb. 2, 1993.

In another indicator embodiment for a bleach-containing composition, there is a particulate colored composition for addition to an oxygen-based bleach composition, wherein the particulate composition contains a water-soluble binder and a water-soluble dye that loses its color upon decomposition in an aqueous solution of the oxygen bleach.

Similarly to the dye indicator description above, the water-soluble dye used to make a particulate colored composition is the same as the dyes discussed above. In this embodiment, the dyes are used in an amount of 0.0005 to 5% per 100 weights parts of the particulate colored composition. The water soluble binder used acts as a protective layer for the dye and examples of such suitable binders include any water-soluble polymer or other material of comparatively high molecular weight that acquires adhesive properties when containing water. Non limiting examples include methyl cellulose, carboxymethyl cellulose, hydroxymethyl cellulose, hydroxyethyl cellulose, sodium alginate, guaiac gum, gum arabic, gelatin, casein, collagen, chitin, chitosan, polyvinyl alcohol, sodium polyacrylate, polyethylene oxide, polyoxyethylene oxypropylene copolymers, polyvinyl pyrrolidone, and other such water-soluble macromolecules; propyl naphthalenesulfonate, butyl naphtalenesulfonate, formaldehyde condensates of naphthalenesulfonates, other naphthalenesulfonate-based surfactants, linear alkylbenzenesulfonates with carbon number of 8 to 22, α-olefinsulfonates with carbon number of 8 to 22, polyoxyethylene alkyl ether sulfuric acid esters with carbon numbers of 8 to 22, alkylphosphoric acid esters with carbon numbers of 8 to 22, and other such anionic surfactants; and polyoxyethylene alkyl ethers with carbon numbers of 8 to 22, polyoxyethylene alkyl phenyl ethers with carbon numbers of 8 to 22, sorbitan fatty acid esters with carbon numbers of 8 to 22, glycerol fatty acid esters, and other such nonionic surfactants. Such water-soluble macromolecules or surfactants may be used individually or jointly, and they may also be used singly or as combinations of two or more components.

Such water-soluble binders should be used in an amount ranging from 0.1 to 20 wt %, and preferably 0.5 to 10 wt %, per 100 weight parts of the particulate colored composition. See JP Kokoku Publication No. 7-21158, published on Mar. 8, 1995.

Dyes can also decolorize by hydrolyzation of the dye, which decomposes the chromophore of the dye. This is preferred in non-bleach containing detergent compositions since an oxidation reaction is not required. Preferred dyes for hydrolyzation are dyes with a functional group that can be hydrolyzed such as phenolphthalein and phenol red. Such dyes are preferably used in quantities such as 0.001% to 0.5% of the detergent composition.

In another embodiment, the concentrated detergent solution generates heat so that when the container with the solution becomes warm, the user will know that it is ready to use due to the change in temperature. Combination of acidic and basic compounds in the composition can be used to generate a heat of neutralization (e.g. citric acid and carbonate) or heat of hydration (e.g. carbonate). In yet another embodiment, the detergent composition further contains bicarbonate and citric acid in order to generate bubbles in the concentrated detergent solution. The bubbles can be used as an indicator to the consumer of when the solution is ready for use.

G. Use of hand-held container

The user combines a pre-determined amount of detergent composition and solvent in the container to form a concentrated detergent solution. When concentrated detergent solutions are made to be used, at least partly, in the washing machine, there are preferred dosage levels of detergent compositions in relation to the volume of water in the tub of the washing machine. For example, for a tub that will use about 70 liters of water for its washing cycle, the recommended dosage of the granular detergent composition is about 70 grams. Table 2 below lists the preferred dosage levels:

TABLE 2

| Approximate volume of water in tub | Preferred dosage of granules | Preferred dosage of liquids | Preferred dosage of paste | Preferred dosage of tablet | Preferred dosage of gel |
|---|---|---|---|---|---|
| 70 liters | 70 grams | 47 grams | 56 grams | 70 grams | 70 grams |
| 60 liters | 60 grams | 40 grams | 48 grams | 60 grams | 60 grams |
| 40 liters | 40 grams | 27 grams | 32 grams | 40 grams | 40 grams |
| 30 liters | 30 grams | 20 grams | 24 grams | 30 grams | 30 grams |

The concentrated detergent solution of the present invention can be used to pre-treat particularly soiled areas such as collars, cuffs, and stains. In addition, the solution can be poured into the washing machine at the beginning of the wash cycle. The solution can also be used to pre-soak fabric. Another use is to place the hand-held container having the concentrated detergent solution into the tub of the washing machine so that the solution gradually empties into the tub upon the mechanical agitation of the washing machine. Any combinations of the uses mentioned above are also possible.

The user can optionally rinse the container with the water that is being released by the washing machine during the filling of the machine tub at the beginning of the wash cycle. The user can also rinse the container in a sink. It is preferred to have a reusable container.

The following examples illustrate preferred methods of the present invention:

EXAMPLE 18

The user combines 30 grams of a granular detergent composition and 180 milliliters of water in the hand-held container. In one preferred embodiment, the user fills the container with water up to the appropriate line indicated on the container. The user preferably adds lukewarm water that is about 40° C. The user then secures the container and then agitates the contents in the container with an up and down shaking motion. After about 20 vertical shaking motions, a concentrated detergent solution having a surface tension of about 25 dyne/cm is formed. The user then pre-treats particular areas of the fabric with the concentrated detergent solution. Then the user places the pre-treated fabric into the washing machine tub and pours the remaining concentrated detergent solution into the tub. The contents of the machine tub are then washed by the washing machine.

EXAMPLE 19

The user combines 30 grams of a granular detergent composition and 180 milliliters of water in the hand-held container. The user preferably adds water that is about 20° C. The user then secures the container and then agitates the container with an up and down shaking motion. After about 20 vertical shaking motions, a concentrated detergent solution having a surface tension of about 30 dyne/cm is formed. The user pre-treats particular areas of the fabric, opens the container, and then places the container containing the remaining solution into the machine tub. The user finally washes the fabric in the washing machine.

EXAMPLE 20

The user scoops about 60 grams of a granular detergent composition and combines 150 milliliters of water having a temperature of about 95° C. in the hand-held container. The detergent composition does not contain bleach or enzymes. The container's contents are not agitated. A concentrated detergent solution having a surface tension of about 20 dyne/cm is formed. The user then pre-treats and washes the fabric as in Example 18 above.

EXAMPLE 21

The user combines about 60 grams of a granular detergent composition, 50 milliliters of ethanol, and 100 milliliters of water in the hand-held container. The user then secures the container and then agitates the container with an up and down shaking motion. After about 15 vertical shaking motions, a concentrated detergent solution having a surface tension of about 25 dyne/cm is formed. The user then directly pours the contents of the container in the washing machine tub without performing any pre-treatment steps before washing the fabric.

EXAMPLE 22

The user combines 30 grams of a heavy duty liquid laundry detergent composition and 180 milliliters of water in the hand-held container. The user then secures the container and then agitates the container with an up and down shaking motion. After about 10 vertical shaking motions, a concentrated detergent solution having a surface tension of about 30 dyne/cm is formed. The user then pre-treats and washes the fabric as in Example 18 above.

EXAMPLE 23

The user combines about 60 grams of a paste laundry detergent composition and 150 milliliters of water in the hand-held container. The user hen secures the container and then agitates the container with an up and down shaking motion. After about 20 vertical shaking motions, a concentrated detergent solution having a surface tension of about 25 dyne/cm is formed. The user then pre-treats and washes the fabric as in Example 18 above.

EXAMPLE 24

The user combines one tablet having about 60 grams and 200 milliliters of water in the hand-held container. The tablet comprises citric acid and sodium bicarbonate. The contents are not agitated. After about 30 seconds, the bubbles that were initially generated upon contact of the tablet and the water subsides, indicating that the concentrated detergent solution is ready for use. A concentrated detergent solution having a surface tension of about 35 dyne/cm is formed. The user then pre-treats and washes the fabric as in Example 18 above.

EXAMPLE 25

The user combines about 30 grams of a granular detergent composition and 180 milliliters of water in the hand-held container. In one preferred embodiment, the user fills the container with water up to the appropriate line indicated on the container. The user preferably adds lukewarm water that is about 40° C. The user then secures the container and then agitates the container with an up and down shaking motion. The solution turns a noticeable, bluish color as soon as the water and detergent composition are mixed together. After about 20 vertical shaking motions, a concentrated detergent solution having a surface tension of about 30 dyne/cm is formed. After the container is shaken 20 times (or in about 10 seconds from the start of agitation), the concentrated detergent solution turns from the blue to a clear color, indicating to the user that the concentrated detergent solution is ready for use.

The indicator system used to turn the solution initially blue, then to a clear color is described in more detail. The dye particle is made of a core, including inorganic builder material and surfactant. The core is coated with a nonionic surfactant binder. Next, a pre-mixture of zeolite powder and dye (C. I. Acid Green 5) is made. The pre-mixture is used to cover the coated core in order to form a free-flowing dye particle. The bleach is made of a sodium percarbonate. The bleach has three layers of nonionic surfactant binder. There is a thin layer of zeolite between each binder layer. Finally, the bleach is covered with a zeolite powder in order to form a free-flowing bleach particle.

The user then pre-treats particular areas of the fabric with the concentrated detergent solution. Then the user places the pre-treated fabric into the washing machine tub and pours the remaining concentrated detergent solution into the tub. The contents of the machine tub are then washed by the washing machine.

We claim:

1. A method of predissolving a detergent composition, comprising the steps of:

a. providing a hand-held container; and b. combining a detergent composition, an indicator and a solvent in the container to form a concentrated detergent solution having a surface tension value of from about 10 dyne/cm to about 50 dyne/cm, wherein the indicator indicates when the detergent composition is sufficiently dissolved in the solvent.

2. The method as in claim 1, wherein the solvent is water.

3. The method as in claim 1, wherein the detergent composition comprises bleach.

4. The method as in claim 1, wherein the detergent composition comprises a surfactant.

5. The method as in claim 1, wherein the detergent composition is a granular detergent composition.

6. A method according to claim 1, wherein the weight ratio of the detergent composition to the solvent is from about 5:1 to 1:10.

7. A method of predissolving a detergent composition comprising the steps of:

a. providing a hand-held container; and b. combining a detergent composition and a solvent in the container;

c. agitating the container to form a concentrated detergent solution having a surface tension value of from about 10 dyne/cm to about 50 dyne/cm; and d. applying the concentrated detergent solution to a fabric material.

8. The method as in claim 7, wherein the concentrated detergent solution is applied to the fabric material by pretreating selected areas of the fabric.

9. The method as in claim 7, wherein the concentrated detergent solution is applied to the fabric material by pretreating the fabric, followed by machine washing the fabric by pouring the remainder of the solution into the washing machine.

10. The method of claim 7, wherein the concentrated detergent solution is applied to the fabric material by pouring the entire solution into a washing machine which contains the fabric material.

11. A method according to claim 7, wherein the solvent is water.

12. A method according to claim 7, wherein the weight ratio of the detergent composition to the solvent is from about 5:1 to 1:10.

13. A method according to claim 7, wherein the concentrated detergent solution has a surface tension value of from about 20 dyne/cm to about 40 dyne/cm.

14. A method according to claim 7, wherein the concentrated detergent solution has a surface tension value of from about 25 dyne/cm to about 35 dyne/cm.

15. A method of predissolving a detergent composition, comprising the steps of:

a. providing a hand-held container;

b. combining a detergent composition and a solvent in the container to form a concentrated detergent solution having a surface tension value of from about 10 dyne/cm to about 50 dyne/cm; and c. applying the concentrated detergent solution to a soiled surface to clean the surface.

16. A method according to claim 15, wherein the weight ratio of the detergent composition to the solvent is from about 5:1 to 1:10.

17. A method according to claim 15, wherein the solvent is water.

18. A method according to claim 15, wherein the surface comprises a hard surface or carpet.

19. A method according to claim 15, wherein the surface comprises a wall or dishes.

* * * * *